US009741276B2

(12) United States Patent
Nishinohara et al.

(10) Patent No.: US 9,741,276 B2
(45) Date of Patent: Aug. 22, 2017

(54) ELECTRO-OPTICAL DEVICE, METHOD OF MEASURING CHARACTERISTICS OF ELECTRO-OPTICAL DEVICE, AND SEMICONDUCTOR CHIP

(71) Applicant: Rohm Co., Ltd., Kyoto (JP)

(72) Inventors: Daisuke Nishinohara, Kyoto (JP); Akimasa Maruo, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 143 days.

(21) Appl. No.: 14/746,988

(22) Filed: Jun. 23, 2015

(65) Prior Publication Data

US 2015/0379910 A1 Dec. 31, 2015

(30) Foreign Application Priority Data

Jun. 26, 2014 (JP) ..... 2014-131478

(51) Int. Cl.
*G09G 3/3241* (2016.01)
*G09G 3/00* (2006.01)

(52) U.S. Cl.
CPC ..... *G09G 3/006* (2013.01); *G09G 3/3241* (2013.01); *G09G 2320/0673* (2013.01); *G09G 2330/023* (2013.01); *G09G 2330/12* (2013.01)

(58) Field of Classification Search
CPC ..... G09G 3/006; G09G 3/3241; G09G 2320/0673; G09G 2330/023; G09G 2330/12
See application file for complete search history.

(56) References Cited

U.S. PATENT DOCUMENTS 7,696,773 B2 * 4/2010 Levey ..... G09G 3/006 324/760.01
7,928,936 B2 * 4/2011 Levey ..... G09G 3/3233 315/169.3
8,164,546 B2 * 4/2012 Odawara ..... G09G 3/3233 345/211
8,217,867 B2 * 7/2012 Hamer ..... G09G 3/3233 324/762.09
8,217,928 B2 * 7/2012 Levey ..... G09G 3/3233 345/211
8,299,983 B2 * 10/2012 Levey ..... G09G 3/3233 345/212

FOREIGN PATENT DOCUMENTS

JP 2005-283816 10/2005
JP 2013-025300 2/2013

* cited by examiner

*Primary Examiner* — Ricardo L Osorio
(74) *Attorney, Agent, or Firm* — Fish & Richardson P.C.

(57) ABSTRACT

An electro-optical device includes: a display unit having a plurality of pixel circuits each including a driving transistor and a light emitting element that emits light depending on a current output from the driving transistor when a voltage is applied to a gate terminal of the driving transistor; and a test unit having a test unit connection switch connected to the gate terminal of the driving transistor of each of the pixel circuits, and a test voltage supply circuit connected to the gate terminal of each of the driving transistors through the test unit connection switch and configured to supply a test voltage to the gate terminal of each of the driving transistors when the test unit connection switch is turned on.

17 Claims, 11 Drawing Sheets

FIG. 5

| Operation mode | Switch Ts | Switch SW1 | Switch SW2 | Switch SW3 | Switch SW4 |
|---|---|---|---|---|---|
| (a) Normal light emitting operation | ON | OFF | ON | OFF | OFF |
| (b) Luminance test | ON | ON | OFF | ON | ON |
| (c) Voltage-current characteristics test | ON | ON | OFF | OFF | ON |
| (d) Voltage drop test | ON | ON | OFF | OFF | ON |

10b

16

ELECTRO-OPTICAL DEVICE, METHOD OF MEASURING CHARACTERISTICS OF ELECTRO-OPTICAL DEVICE, AND SEMICONDUCTOR CHIP

CROSS-REFERENCE TO RELATED APPLICATION

This application is based upon and claims the benefit of priority from Japanese Patent Application No. 2014-131478, filed on Jun. 26, 2014, the entire contents of which are incorporated herein by reference.

TECHNICAL FIELD

The present disclosure relates to an electro-optical device, a method of measuring characteristics of the electro-optical device, and a semiconductor chip.

BACKGROUND

Conventionally, various electro-optical devices using a light emitting element, such as an organic light emitting diode (hereinafter, referred to as "OLED") element, have been proposed. The electro-optical devices are generally known to have a configuration in which, for example, scan lines and data lines are wired on a glass substrate and a plurality of pixel circuits are formed to correspond to intersections of the scan lines and the data lines. Further, the pixel circuits are known to be configured to have respective light emitting elements as well as respective driving transistors for enabling a current to flow in the light emitting elements.

In order to meet recent demand for size-reduction and high precision, an electro-optical device using a silicon substrate as a basis for wiring the scan lines and the data lines has been proposed.

Meanwhile, to measure characteristics of the pixel circuits of the conventional electro-optical device, it has been known that with a current source installed in each of a plurality of data lines, a test voltage is applied to a gate terminal of a driving transistor of each pixel circuit connected to the respective data line to allow a current to flow to the respective light emitting element so that luminance emitted by the light emitting element is measured.

As described above, the test of applying the test voltages to the gate terminals of the driving transistors is conventionally performed to measure the characteristics of the pixel circuits of the electro-optical device. However, with recent requirements of miniaturization of the electro-optical device, the driving transistors are increasingly reduced in size, making it difficult to increase withstanding voltages of the driving transistors. Thus, it becomes hard to apply large test voltages to the gates of the driving transistors and the test voltages to be applied to the gate terminals of the driving transistors become smaller. In addition, when the test is performed, it takes time to adjust the test voltages, which vary for each of the plurality of data lines, to be equal among the gate terminals of the driving transistors connected to the data lines, which increases the time for measuring the characteristics of the pixel circuits and leads to an increase in manufacturing cost.

SUMMARY

The present disclosure provides some embodiments of techniques capable of limiting an increase in time necessary to perform a test to measure the characteristics of the pixel circuits and limiting an increase in manufacturing cost.

According to an aspect of the present disclosure, there is provided an electro-optical device, including: a display unit having a plurality of pixel circuits each including a driving transistor and a light emitting element that emits light depending on a current output from the driving transistor when a voltage is applied to a gate terminal of the driving transistor; and a test unit having a test unit connection switch connected to the gate terminal of the driving transistor of each of the pixel circuits, and a test voltage supply circuit connected to the gate terminal of each of the driving transistors through the test unit connection switch and configured to supply a test voltage to the gate terminal of each of the driving transistors when the test unit connection switch is turned on.

According to another aspect of the present disclosure, there is provided a method of measuring characteristics of an electro-optical device, the electro-optical device including a display unit having a plurality of pixel circuits each including a driving transistor and a light emitting element that emits light depending on a current output from the driving transistor when a voltage is applied to a gate terminal of the driving transistor, and a test unit connected to the gate terminal of the driving transistor of each of the pixel circuits, wherein, for a luminance test that measures luminance of the light emitting element included in each of the pixel circuits, the method including: transmitting a luminance test mode signal from a test device to the electro-optical device; determining whether the electro-optical device has received the luminance test mode signal; when it is determined that the electro-optical device has received the luminance test mode signal, electrically connecting the test unit to the gate terminal of the driving transistor of each of the pixel circuits and for each light emitting element that is a target of the luminance test, supplying a test voltage of a predetermined voltage level from the test unit to the gate terminal of the driving transistor to allow the light emitting element to emit light; and measuring, by the test device, luminance obtained when the light emitting element of the electro-optical device is allowed to emit light.

According to still another aspect of the present disclosure, there is provided a semiconductor chip, comprising: a display unit having a plurality of pixel circuits each including a driving transistor and a light emitting element that emits light depending on a current output from the driving transistor when a voltage is applied to a gate terminal of the driving transistor; and a test unit having a test transistor including a gate terminal with which the gate terminal of the driving transistor of each of the pixel circuits is connected through a test unit connection switch and also including a drain terminal connected to the gate terminal thereof.

BRIEF DESCRIPTION OF THE DRAWINGS

FIG. 5 is a view illustrating ON/OFF states of a switch Ts and switches SW1 to SW4 in each operation mode of the electro-optical device 10*a* according to the second embodiment of the present disclosure.

DETAILED DESCRIPTION

Hereinafter, each embodiment of the present disclosure will be described with reference to the drawings. Also, numerical values, circuits, materials, and the like described hereinafter may be appropriately selected within the scope of the present disclosure. For example, for the convenience of description, PMOS transistors are used as various switches hereinafter, but they may be replaced with NMOS transistors. It may be also possible to use a PMOS transistor and an NMOS transistor connected in parallel to serve as a single switch.

First Embodiment

Figure 1:
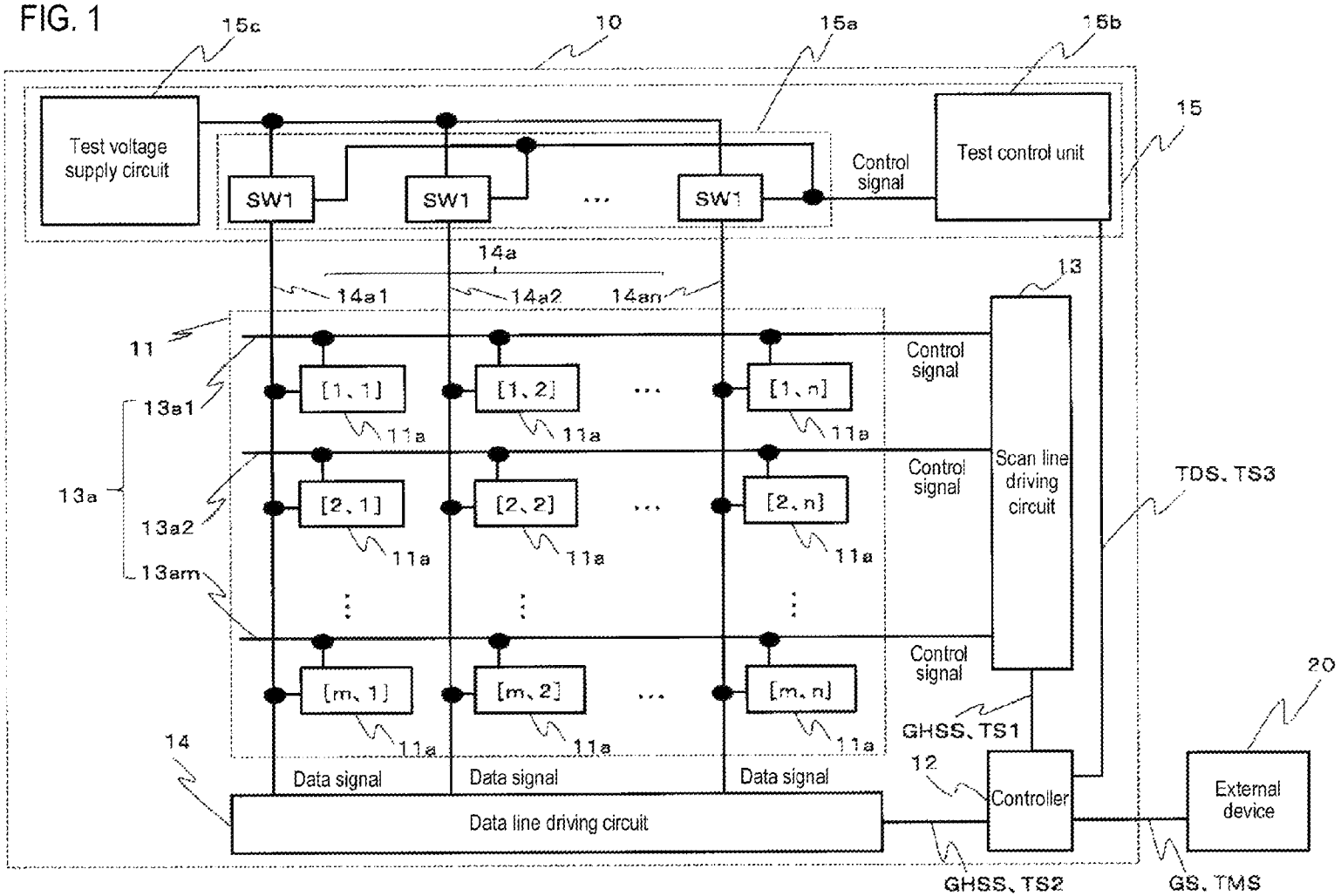
FIG. 1 is a block diagram illustrating a configuration of an electro-optical device 10 according to a first embodiment of the present disclosure.

FIG. 1 is a block diagram illustrating a configuration of an electro-optical device 10 according to a first embodiment of the present disclosure. When an image signal GS is received from an external device 20, the electro-optical device 10 displays image data representing information of the image signal GS on a display unit 11.

(Configuration of Electro-Optical Device 10)

The electro-optical device 10 has the display unit 11, a controller 12, a scan line driving circuit 13, a data line driving circuit 14, and a test unit 15.

The display unit 11 has a plurality of pixel circuits 11*a* arranged in a grid shape. In FIG. 1, for the convenience of description and illustration, sequential addresses [1, 1] to [m, n] (where m and n are natural numbers) are allocated to the respective pixel circuits 11*a* arranged in the grid shape, where m denotes the number of rows of the pixel circuits 11*a* of the display unit 11, and n denotes the number of columns of the pixel circuits 11*a* of the display unit 11. Also, in FIG. 1, for convenience of description and illustration, some portions of the pixel circuits 11*a* are omitted. Each of the pixel circuits 11*a* has a driving transistor and a light emitting element that is self-luminous upon receiving a current output from the driving transistor.

Further, the pixel circuits 11*a* of the display unit 11 have a screen resolution of an XGA (eXtended Graphics Array) and the number of rows equaling m=1024×the number of primary colors and the number of columns equaling n=768, for example.

Here, the number of primary colors is the number of primary color elements required for representing colors. Three primary colors of red, green, and blue are general, but white, yellow, and the like may also be used as the primary colors.

The controller 12 is connected to each of the external device 20, the scan line driving circuit 13, the data line driving circuit 14, and the test unit 15. When the image signal GS supplied from the external device 20 is received, the controller 12 generates an image display control signal GHSS having commands for allowing each light emitting element of each pixel circuit 11*a* to emit light for a predetermined period at a predetermined luminance, and outputs the generated image display control signal GHSS to the scan line driving circuit 13 and the data line driving circuit 14 to control the scan line driving circuit 13 and the data line driving circuit 14 accordingly. Further, when the image signal GS supplied from the external device 20 is received, the controller 12 generates and supplies a normal operation signal TDS to the test unit 15. In addition, when a test mode signal TMS supplied from the external device 200 is received, the controller 12 generates and supplies a test signal TS1 to the scan line driving circuit 13, generates and supplies a test signal TS2 to the data line driving circuit 14, and generates and supplies a test signal TS3 to the test unit 15.

Here, the image signal GS is a signal determining, for each frame that is a unit image data, to which degree of luminance each of the light emitting elements of the pixel circuits 11*a* of the display unit 11 is allowed to emit light. Further, the external device 20 supplying the image signal GS may be an image conversion device having a function to generate the image signal GS from the image data and supply the same to the controller 12.

The scan line driving circuit 13 is disposed to be adjacent to the display unit 11. A plurality of scan lines 13*a* are arranged to extend in a row direction of the pixel circuits 11*a* from the scan line driving circuit 13. The scan lines 13*a* include the scan lines 13*a*1 to 13*am* that correspond to the number m of rows of the pixel circuits 11*a*. Here, the pixel circuits 11*a* denoted by addresses [1,1] to [1,n] are connected to the scan line 13*a*1, and the pixel circuits 11*a* denoted by addresses [2,1] to [2,n] are connected to the scan line 13*a*2. Also, the pixel circuits 11*a* denoted by addresses [m, 1] to [m, n] are connected to the scan line 13*am*. The scan lines 13*a* represented by scan lines 13*a*3 to scan lines 13*a*(*m*−1) are arranged between the scan line 13*a*2 and the scan line 13*am*, but they are omitted for the convenience of description and illustration.

When the image display control signal GHSS is received from the controller 12, the scan line driving circuit 13 outputs a low level signal having, e.g., 0 V, to a corresponding one of the scan lines 13*a*1 to 13*am*, as a scan signal for selecting the target pixel circuits 11*a* to allow the corresponding light emitting elements to emit light during a period set in the image display control signal GHSS. During the remaining period, the scan line driving circuit 13 outputs a high level signal having, e.g., 5 V, to the corresponding scan lines 13*a*1 to 13*am*, as a scan signal for non-selecting the pixel circuits 11*a*. Further, when the test signal TS1 is received from the controller 12, the scan line driving circuit 13 outputs a low or high level scan signal to each of the scan lines 13*a*1 to 13*am* according to commands included in the test signal TS1.

The data line driving circuit 14 is disposed to be adjacent to the display unit 11. A plurality of data lines 14*a* are arranged to extend in a column direction of the pixel circuits 11*a* from the data line driving circuit 14. The data lines 14*a* include the data lines 14*a*1 to 14*an* that correspond to the number n of columns of the pixel circuits 11*a*. Here, the pixel circuits 11*a* denoted by addresses [1, 1] to [m, 1] are connected to the data line 14*a*1, and the pixel circuits 11*a* denoted by addresses [1, 2] to [m, 2] are connected to the data line 14*a*2. The pixel circuits 11*a* denoted by addresses [1, n] to [m, n] are connected to the data line 14*an*. Also, the data lines 14*a* represented by data lines 14*a*3 to data lines 14*a*(*n*−1) are arranged between the data line 14*a*2 and the data line 14*an*, but they are omitted for the convenience of description and illustration.

When the image display control signal GHSS is received from the controller 12, in order to allow each of the pixel circuits 11*a* to emit light with a corresponding luminance during a period set in the image display control signal GHSS, the data line driving circuit 14 outputs a data signal having voltage levels set for each of the data lines 14*a*1 to 14*an* in the image display control signal GHSS to each of the data lines 14*a*1 to 14*an*. Further, when the test signal TS2 is received from the controller 12, the data line driving circuit 14 outputs a data signal having a predetermined voltage to each of the data lines 13*a*1 to 13*am* according to commands included in the test signal TS2.

The test unit 15 includes test unit connection switches 15*a*, a test control unit 15*b*, and a test voltage supply circuit 15*c*. The test unit connection switches 15*a* have a plurality of switches SW1 each of which is connected to the respective data line 14*a*1 to 14*an*. The test control unit 15*b* is connected to the controller 12 as well as to each of the switches SW1 of the test unit connection switches 15*a* to control turning on/off of each switch SW1. When a normal operation signal TDS is received from the controller 12, the test control unit 15*b* supplies a control signal for turning off each switch SW1 to each switch SW1.

Further, when the test signal TS3 is received from the controller 12, the test control unit 15*b* supplies, to each switch SW1, a control signal for turning on the switch SW1. The test voltage supply circuit 15*c* is connected to each switch SW1 and accordingly connected to each of the data lines 14*a*1 to 14*an* through each switch SW1. When the switch SW1 is turned on, the test voltage supply circuit 15*c* is electrically connected to each of the data lines 14*a*1 to 14*an*. Then, the test voltage supply circuit 15*c* generates a test voltage having a predetermined voltage level and supplies the same to the data lines 14*a*1 to 14*an*, i.e., to each pixel circuit 11*a* through the data lines 14*a*1 to 14*an*.

Figure 2:
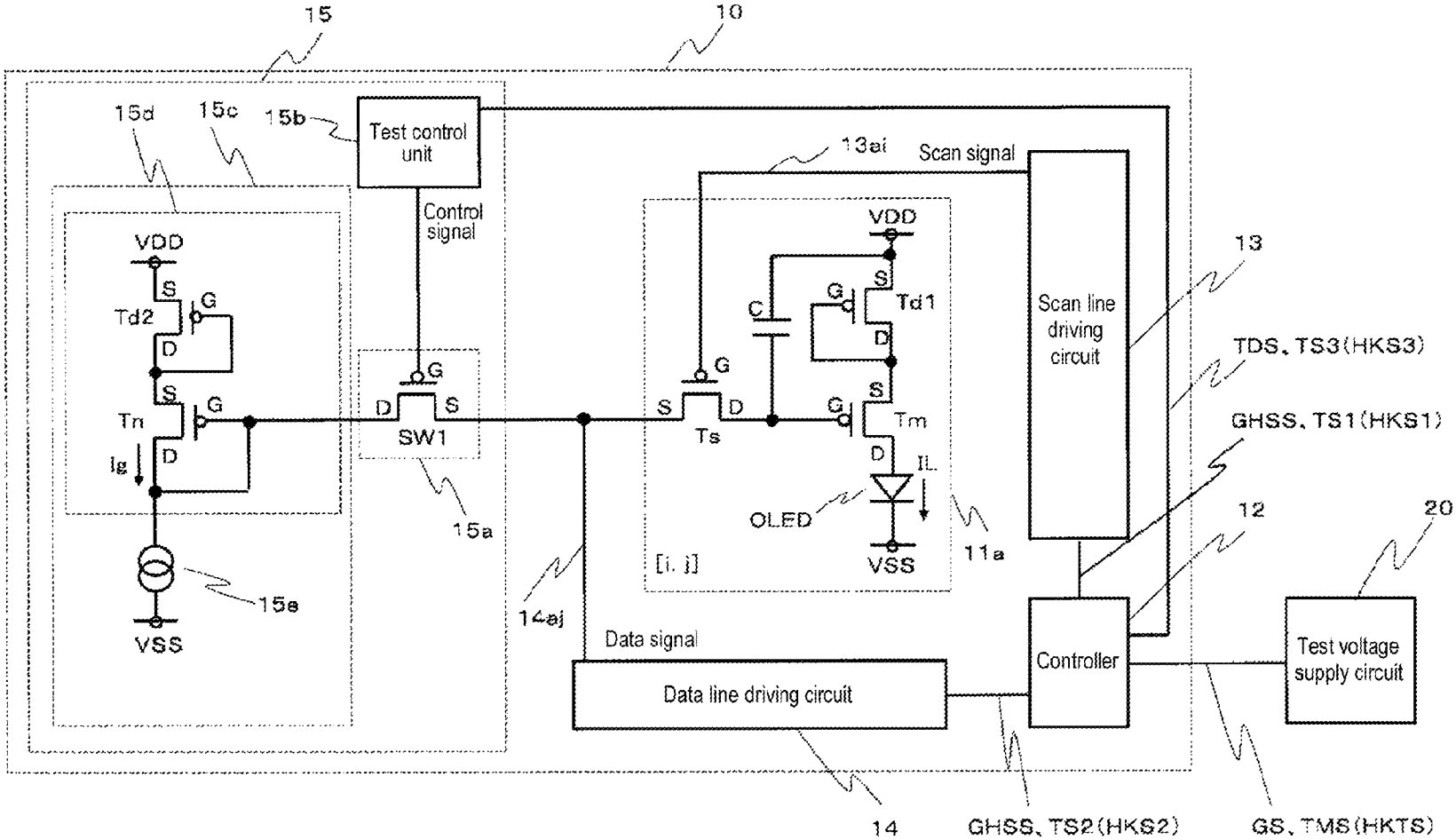
FIG. 2 is a view illustrating a detailed circuit configuration of a pixel circuit 11*a* and a test unit 15 of the electro-optical device 10 according to the first embodiment of the present disclosure.

FIG. 2 is a view illustrating a circuit configuration of the pixel circuit 11*a* and the test unit 15 of the electro-optical device 10 according to the first embodiment of the present disclosure. For the same components as those of FIG. 1, the same reference numerals are used and descriptions thereof will be omitted. Also, for the convenience of description and illustration, FIG. 2 illustrates a circuit configuration of one pixel circuit 11*a* corresponding to an address [i, j] (1≤i≤m, 1≤j≤n, and i and j are natural numbers), the scan line 13*ai* and the data line 14*aj* corresponding thereto, and the switch SW1 corresponding to the data line 14*aj*, but this is not different for a circuit configuration of the other pixel circuit 11*a* corresponding to the other address, a relationship of the other scan line 13*a* and the other data line 14*a* corresponding thereto, and a relationship of the other data line 14*a* and the other switch SW1 corresponding thereto.

The pixel circuit 11*a* is configured to include a switch Ts as a pixel selection switch, a capacitor C, a transistor Td1, a driving transistor Tm, and a light emitting element (OLED). The switch Ts is configured as a PMOS transistor whose gate terminal G and source terminal S are respectively connected to the scan line 13*ai* and the data line 14*aj*. One end of the capacitor C is connected to a drain terminal D of the switch Ts, i.e., connected to the data line 14*aj* through the switch Ts. The other end of the capacitor C is connected to a power source VDD having a potential of, e.g., 5 V. The transistor Td1 is configured as a PMOS transistor whose source terminal S is connected to the power source VDD as well as the other end of the capacitor C. A gate terminal G and a drain terminal D thereof are commonly connected so that the transistor Td1 and the driving transistor Tm may be operated in a saturation region. Alternatively, a resistor element may be provided, instead of the transistor Td1, without being limited thereto. The driving transistor Tm may be configured as a PMOS transistor whose gate terminal G is connected to the drain terminal D of the switch Ts, i.e., the PMOS transistor, as well as the one end of the capacitor C so that the gate terminal G of the driving transistor Tm is connected to the data line 14*aj* through the switch Ts. Further, in the driving transistor Tm, a source terminal S is connected to the drain terminal D of the transistor Td1, i.e., connected to the power source VDD through the transistor Td1. The light emitting element (OLED) is an organic light emitting diode whose anode is connected to the drain terminal D of the driving transistor Tm. A cathode thereof is connected to a power source VSS having a voltage level lower than that of the power source VDD, for example, a potential of 0 V.

In the pixel circuit 11*a*, when the gate terminal G of the switch Ts receives a low level scan signal from the scan line driving circuit 13 through the scan line 13*ai*, the switch Ts is turned on and the gate terminal G of the driving transistor Tm is electrically connected to the data line 14*aj*. At this time, if a data signal having a predetermined voltage level is supplied from the data line driving circuit 14 to the data line 14*aj*, the data signal is supplied to the capacitor C and the gate terminal G of the driving transistor Tm so that a current IL flows to the light emitting element (OLED) to allow it to emit light. Here, electric charges corresponding to the potential of the data line 14*aj* are accumulated in the capacitor C.

The switch SW1 of the test unit connection switch 15*a* of the test unit 15 is configured as a PMOS transistor whose gate terminal G and source terminal S are respectively connected to the test control unit 15*b* and to the data line 14*aj*. An ON/OFF operation of the switch SW1 is controlled by a control signal supplied from the test control unit 15*b* to the gate terminal G of the switch SW1. For example, when a signal having a low level of, e.g., 0 V, is supplied as a control signal, the switch SW1 is turned on and, when a signal having a high level of, e.g., 5 V, is supplied as a control signal, the switch SW1 is turned off.

The test voltage supply circuit 15*c* of the test unit 15 includes a test circuit 15*d* and a constant current source 15*e*. The test circuit 15*d* includes a transistor Td2 and a test transistor Tn. The transistor Td2 is configured as a PMOS transistor whose source terminal S is connected to the power source VDD. A gate terminal G and a drain terminal D thereof are commonly connected so that the test transistor Tn may be operated in a saturation region. A resistor element may be provided, instead of the transistor Td2, without being limited thereto. The test transistor Tn is configured as a PMOS transistor whose source terminal S is connected to the drain terminal D of the transistor Td2, i.e., connected to the power source VDD through the transistor Td2. In addition, a gate terminal G of the test transistor Tn is connected to the drain terminal D of the switch SW1 and also commonly connected to a drain terminal D of the test transistor Tn. The constant current source 15*e* has one end connected to the test transistor Tn and the other end connected to a power source VSS having, e.g., 0 V. The constant current source 15*e* is previously set to cause a current Ig having a particular current value, on which a voltage level of the test voltage generated by the test voltage supply circuit 15*c* is based, to flow through the test transistor Tn.

When the low level control signal is supplied from the test control unit 15*b* to the gate terminal G of the switch SW1 to turn on the switch SW1, the gate terminal G of the test transistor Tn in the test voltage supply circuit 15*c* is electrically connected to the data line 14*aj*. At this time, while the switch Ts is in an ON state, the test voltage is supplied from the test voltage supply circuit 15*c* to the gate terminal G of the driving transistor Tm to allow the light emitting element (OLED) to emit light. That is, when the switch SW1 is turned on, the test voltage supply circuit 15*c* supplies the test voltage to the gate terminal G of the driving transistor Tm through the switch SW1 to allow the light emitting element (OLED) to emit light.

Since the gate terminal G and the drain terminal D of the test transistor Tn are commonly connected, when the gate terminal G of the driving transistor Tm and the gate terminal G of the test transistor Tn are electrically connected, i.e., when the test voltage supply circuit 15*c* and the pixel circuit 11*a* are electrically connected, a current mirror circuit is constituted with the driving transistor Tm and the test transistor Tn, i.e., with the pixel circuit 11*a* and the test voltage supply circuit 15*c*.

Further, the test transistor Tn and the driving transistor Tm are formed as PMOS transistors having the same configuration such that voltage-current characteristics (a relationship between a voltage applied to the gate terminal G and a current flowing in that case) of the test transistor Tn and voltage-current characteristics of the driving transistor Tm are the same. As the test transistor Tn and the driving transistor Tm are formed as the PMOS transistors having the same configuration, a difference in characteristics between the two transistors caused by manufacturing variations of the transistors may be reduced, and thus, in case of configuring the current mirror circuit with the two transistors, the current Ig flowing in the test transistor Tn may be more accurately reflected in the driving transistor Tm. Further, the transistor Td1 and the transistor Td2 are formed as PMOS transistors having the same configuration and the transistor Td1 is formed as a PMOS transistor having the same configuration as that of the driving transistor Tm. Please note that transistors having the same configuration are mere examples, but is not an essential requirement.

Further, although not shown, in the test unit 15, a plurality of the test circuits 15*d*, i.e., a plurality of a serial connection of the test transistor Tn and the transistor Td2, may be connected in parallel between the power source VDD and the constant current source 15*e*. In such a case, when allowing the current Ig to flow to the test transistors Tn, the current generated by the constant current source 15*e* may be increased depending on the number of the test transistors Tn connected in parallel. Then, as a result, the current Ig flowing in each test transistor Tn may be more precisely adjusted and further, the test voltage may be more precisely generated. In this regard, even when only the test transistors Tn are connected between the power source VDD and the constant current source 15*e*, the same effect may be obtained. In a case where a plurality of test units 15 are prepared, for example, the test units 15 may be disposed in a grid shape in 40 rows×40 columns and may be configured to be smaller than the area of the display unit 11.

(Normal Light Emitting Operation of Electro-Optical Device 10)

Next, a flow of the normal light emitting operation of the electro-optical device 10 according to the first embodiment of the present disclosure will be described with reference to FIG. 2. In the present disclosure, the normal light emitting operation indicates that the light emitting elements (OLED) emit light when the electro-optical device 10 receives the image signal GS supplied from the external device 20, for example.

First, the image signal GS is supplied from the external device 20 to the controller 12. When the image signal GS is received from the external device 20, based on contents of the image signal GS, the controller 12 generates and outputs an image display control signal GHSS to the scan line driving circuit 13 and the data line driving circuit 14. Further, when the image signal GS is received from the external device 20, the controller 12 generates and supplies a normal operation signal TDS to the test unit 15.

When the image display control signal GHSS is received, in order to select the pixel circuits 11*a* that are determined in the image display control signal GHSS as targets for allowing the corresponding light emitting elements (OLEDs) to emit light, the scan line driving circuit 13 outputs a low level scan signal to each corresponding scan line 13*a* during a period set in the image display control signal GHSS. Further, when the image display control signal GHSS is received, the data line driving circuit 14 outputs a data signal having voltage levels set by the image display control signal GHSS for each of the data lines 14*a*1 to 14*an* during a period set in the image display control signal GHSS. In addition, when the normal operation signal TDS is received, the test control unit 15*b* of the test unit 15 outputs a high level control signal to the gate terminal G of the switch SW1 during a period set in the normal operation signal TDS to turn off the switch SW1.

When the low level scan signal is supplied to the scan line 13*a*, the switch Ts of the pixel circuit 11*a* is turned on so that the data signal from the data line 14*a* is applied to the gate terminal G of the driving transistor Tm to turn on the driving transistor Tm during a predetermined period. When the driving transistor Tm is turned on, the current IL flows as a driving current according to characteristics of the driving transistor Tm to the light emitting element (OLED) so that the light emitting element (OLED) emits light during the predetermined period. At this time, electric charges corresponding to a voltage level of the data signal are accumulated in the capacitor C. Further, since the switch SW1 is turned off during the normal light emitting operation as described above, a test voltage is not applied from the test unit 15 to the gate terminal G of the driving transistor Tm.

When each of the light emitting elements (OLEDs) of the pixel circuits 11*a* emits light for each predetermined period based on the image display control signal GHSS, a single image on the entirety of the display unit 11 is displayed. Further, as described above, since the electric charges corresponding to the voltage level of the data signal are accumulated in the capacitor C, even after the switch Ts is turned off, a voltage is applied from the capacitor C to the gate terminal G of the driving transistor Tm during a certain period and thus, the light emitting element (OLED) maintains light emission thereof during the certain period.

(Method of Measuring Characteristics of Electro-Optical Device 10)

Figure 3:
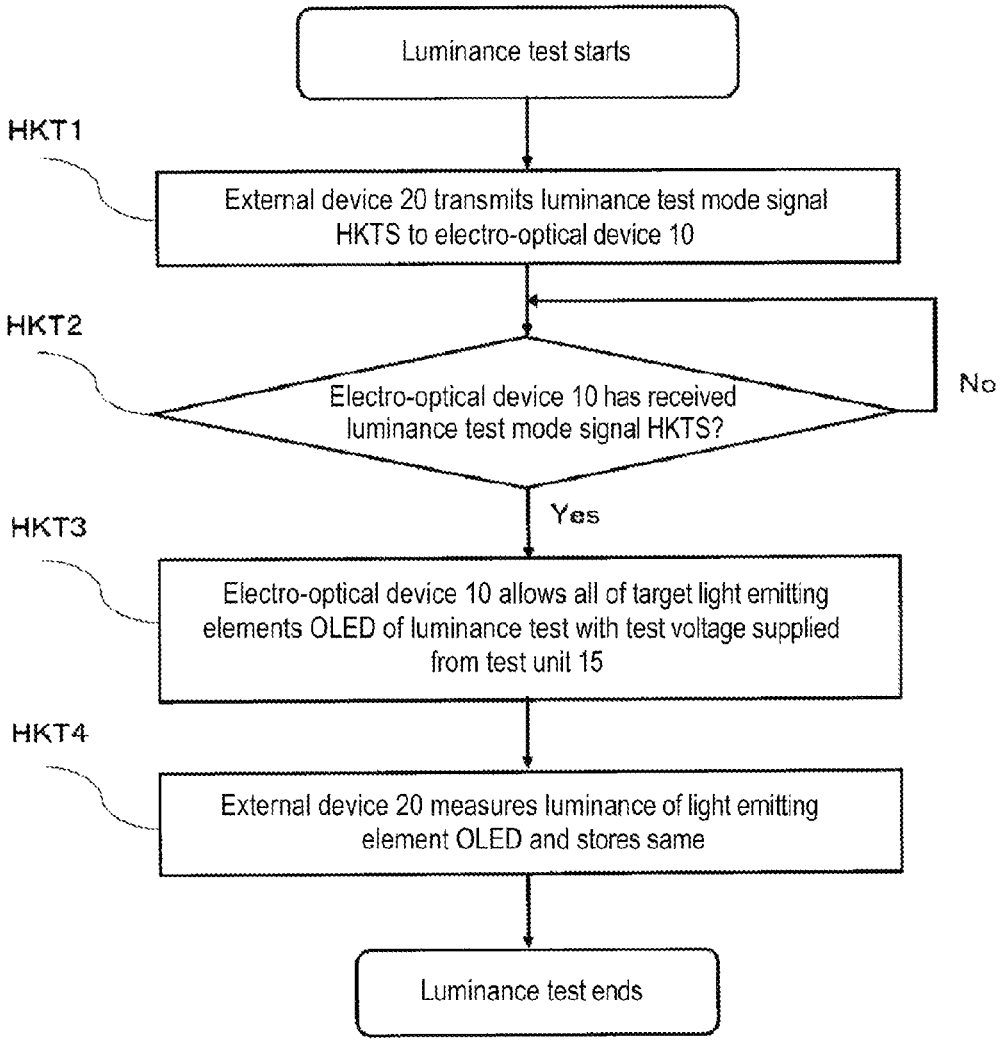
FIG. 3 is a flowchart illustrating a luminance test of the electro-optical device 10 according to the first embodiment of the present disclosure.

FIG. 3 is a flowchart illustrating a luminance (or emission luminance) test of the pixel circuit 11*a* as a method of measuring characteristics of the electro-optical device 10 according to the first embodiment of the present disclosure.

The luminance test according to the first embodiment of the present disclosure is for measuring luminance of each of the light emitting elements (OLEDs) provided in the pixel circuits 11*a* of the electro-optical device 10 illustrated in FIGS. 1 and 2. The luminance test includes step HKT1 of transmitting a luminance test mode signal HKTS as a test mode signal TMS from the external device 20, which is used as a test device, to the electro-optical device 10, step HKT2 of determining whether the electro-optical device 10 has received the luminance test mode signal HKTS from the external device 20, step HKT3 of allowing all of the light emitting elements (OLEDs) which are targets of the luminance test, to emit light by supplying a test voltage from the test unit 15 if it is determined that the electro-optical device 10 has received the luminance test mode signal HKTS, and step HKT4 of measuring luminance of the light emitting elements (OLEDs) of the electro-optical device 10 by the external device 20. In this embodiment, a case in which a pixel circuit 11*a* corresponding to an address [i, j] among the pixel circuits 11*a* provided in the display unit 11 is a target of the luminance test will be described appropriately with reference to the components illustrated in FIG. 2.

First, in step HKT1, the external device 20 transmits the luminance test mode signal HKTS to the controller 12 of the electro-optical device 10.

Next, in step HKT2, the electro-optical device 10 determines whether the controller 12 has received the luminance test mode signal HKTS.

Thereafter, in step HKT3, when it is determined that the controller 12 has received the luminance test mode signal HKTS, the electro-optical device 10 is switched to a luminance test mode to activate all of the light emitting elements (OLEDs), which are targets of the luminance test, by supplying a test voltage from the test unit 15. The electro-optical device 10 activates the light emitting elements OLEDs in the following order.

When the electro-optical device 10 is switched to the luminance test mode, the controller 12 supplies, to the scan line driving circuit 13, a luminance test signal HKS1 as a test signal TS1 having commands for turning on the switches Ts of all the target pixel circuits 11*a* for the luminance test during a predetermined period in order to activate the light emitting elements (OLEDs) of all the target pixel circuits 11*a* for the luminance test within the display unit 11 to emit light with the same luminance. Further, the controller 12 supplies, to the data line driving circuit 14, a luminance test signal HKS2 as a test signal TS2 having commands for preventing the data signal from being supplied to the data lines 14*a*1 to 14*an* for the period in which the switches Ts are turned on. In addition, the controller 12 supplies, to the test control unit 15*b*, a luminance test signal HKS3 as a test signal TS3 having commands for turning on the switches SW1 connected to the data lines 14*a* to which the target pixel circuits 11*a* for the luminance test are connected, for the period in which the switches Ts are turned on.

When the luminance test signal HKS1 is received from the controller 12, the scan line driving circuit 13 outputs a low level scan signal to each scan line 13*a* connected to the target pixel circuits 11*a* for the luminance test during a period set in the luminance test signal HKS1. Further, when the luminance test signal HKS2 is received from the controller 12, the data line driving circuit 14 stops outputting of the data signal to the data line 14*a* during a period set in the luminance test signal HKS2. In addition, when the luminance test signal HKS3 is received from the controller 12, the test control unit 15*b* supplies a low level control signal to the gate terminal G of each switch SW1 connected to the data line 14*a* to which the target pixel circuits 11*a* for the luminance test are connected, during a period set in the luminance test signal HKS3.

When the low level scan signal is supplied to the scan line 13*ai*, the switch Ts is turned on and the gate terminal G of the driving transistor Tm and the data line 14*aj* are electrically connected. Further, when the low level control signal is supplied from the test control unit 15*b* to the gate terminal G of the switch SW1, the switch SW1 is turned on and the gate terminal G of the test transistor Tn and the data line 14*aj* are electrically connected. Accordingly, the driving transistor Tm of each target pixel circuit 11*a* for the luminance test and the test transistor Tn are electrically connected and a test voltage having a voltage level depending on the current Ig flowing in the test transistor Tn based on a current set in the constant current source 15*e* is supplied to the gate terminal G of the driving transistor Tm.

Here, since the gate terminal G and the drain terminal D of the test transistor Tn are commonly connected as described above, the test voltage supply circuit 15*c* and the pixel circuit 11*a* form a current mirror circuit with the driving transistor Tm, the test transistor Tn, and the constant current source 15*e*. Accordingly, the driving transistor Tm and the test transistor Tn have the same configuration and the same voltage-current characteristics. Thus, the current IL, which is a driving current having the same current level as that of the current Ig flowing in the test transistor Tn, flows from the driving transistor Tm to the light emitting element (OLED) to allow the light emitting element (OLED) to emit light.

Thereafter, in step HKT4, the external device 20 measures luminance of the light emitting elements (OLEDs) of the pixel circuits 11*a* by a camera medium such as an image sensor and stores the measured luminance in a memory (not shown). Then, the luminance test is terminated.

Further, after measuring the luminance of the light emitting elements OLEDs of the electro-optical device 10, the external device 20 may determine whether each luminance is within a range of a desired value. After determining whether the luminance of each light emitting element OLED of the electro-optical device 10 is within a range of a desired value, the external device 20 may also perform a determination of product conformance of the electro-optical device 10. In this case, for example, if all of the luminance obtained from the pixel circuits 11*a* are within the range of a desired value, the external device 20 may determine that the electro-optical device 10 meet product conformance. In addition, if any of the luminance obtained from the pixel circuits 11*a* is not within the range of a desired value, the external device 20 may determine that the electro-optical device 10 fails to meet the product conformance.

Moreover, the external device 20 may perform the luminance test multiple times with test voltages of different voltage levels and measure the luminance of the light emitting elements (OLEDs) corresponding to each voltage level of the test voltage. By measuring the luminance of the light emitting elements (OLEDs) corresponding to each voltage level of the test voltage, it is possible to recognize a variation in the luminance of the light emitting elements (OLEDs) according to a change in the test voltage applied to the gate terminal G of the driving transistor Tm. Thus, gamma characteristics of the pixel circuit 11*a* of the electro-optical device 10, i.e., the voltage-current characteristics of the driving transistor Tm, may be recognized. Accordingly, the image signal GS may be input to the electro-optical device 10 in consideration of the gamma characteristics of the electro-optical device 10 so that displaying the image data on the display unit 11 may be more precisely controlled.

(Effects of First Embodiment)

In the electro-optical device 10 according to the first embodiment of the present disclosure, all of the light emitting elements OLED of the target pixel circuits 11*a* for the luminance test of the electro-optical device 10 are allowed to emit light depending on the test voltage supplied from the test unit 15. Thus, when the luminance test of the electro-optical device 10 is performed, it is not necessary to adjust irregular voltages of the data lines 14*a* to be uniform among the gate terminals G of the driving transistors Tm connected to the data lines 14*a*. Thus, it is possible to reduce the time required for the luminance test of the pixel circuits 11*a* of the electro-optical device 10 and an increase in manufacturing cost may be restrained.

Further, in the electro-optical device 10 according to the first embodiment of the present disclosure, the level of the test voltage applied to the gate terminal G of the driving transistor Tm is determined based on the current value set in the constant current source 15*e* of the test unit 15. Thus, when the luminance test of the electro-optical device 10 is performed, the test unit 15 may supply the test voltage with a stable voltage level to the gate terminal G of the driving transistor Tm so that luminance of the light emitting elements (OLEDs) may be more precisely measured.

In addition, in the electro-optical device 10 according to the first embodiment of the present disclosure, the driving transistor Tm of the pixel circuit 11*a* and the test transistor Tn of the test voltage supply circuit 15*c* are configured as the PMOS transistors having the same configuration and the respective gate terminals G electrically connected to form a current mirror circuit. Thus, the test voltage generated by the test unit 15 may be supplied to the driving transistor Tm with higher precision and thus, luminance of the light emitting element (OLED) may be more precisely measured.

Moreover, the method of measuring characteristics of the electro-optical device 10 according to the first embodiment of the present disclosure has step HKT3 of allowing all the light emitting elements (OLEDs), which are targets of the luminance test, to emit light by supplying the test voltage from the test unit 15. Thus, when the luminance test of the electro-optical device 10 is performed, it is not necessary to adjust irregular voltages of the data lines 14*a* to be uniform among the gate terminals G of the driving transistors Tm connected to the data lines 14*a*. Thus, it is possible to reduce the time required for the luminance test of the pixel circuits 11*a* of the electro-optical device 10 and an increase in manufacturing cost may be restrained.

Second Embodiment

Figure 4:
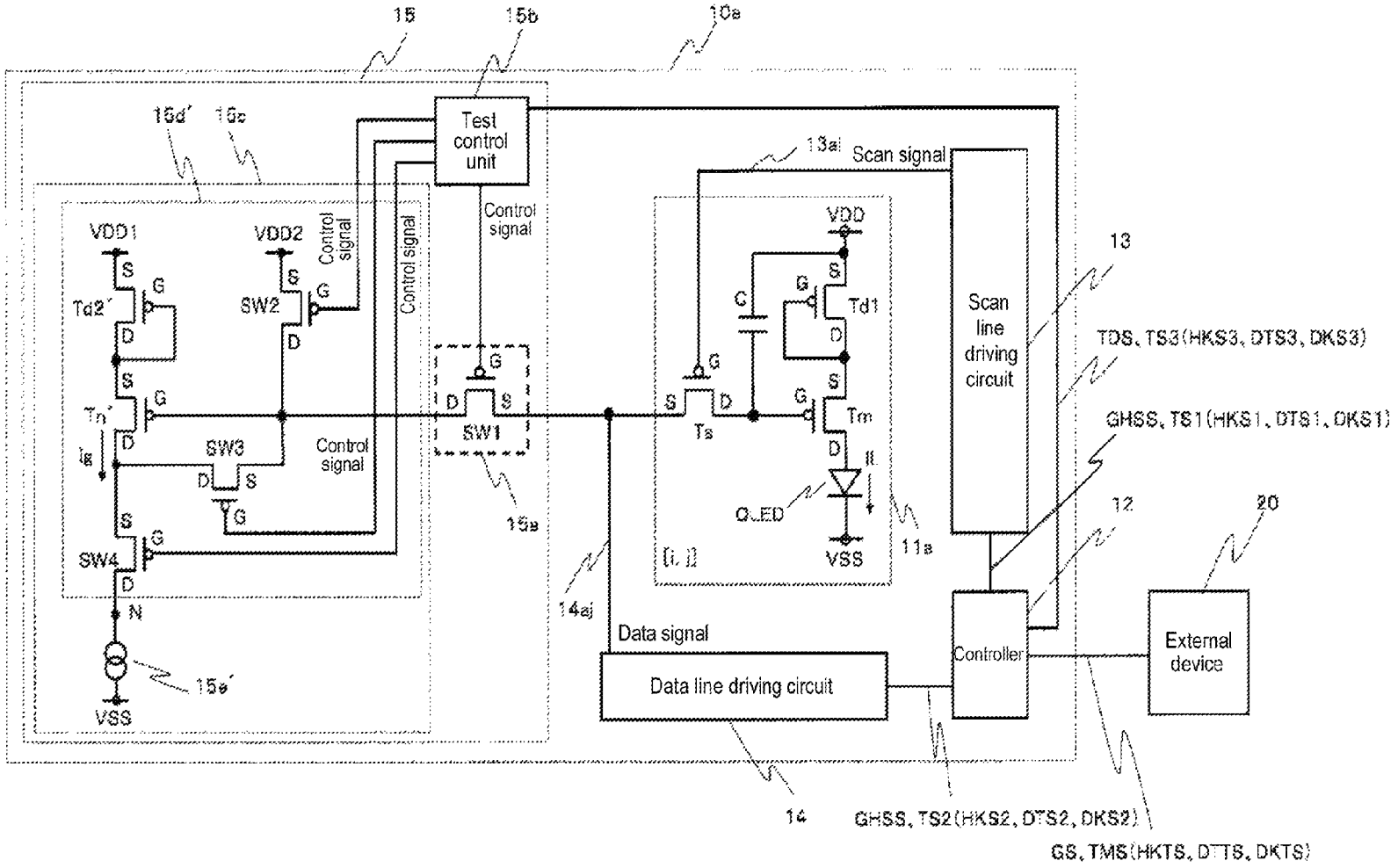
FIG. 4 is a view illustrating a detailed circuit configuration of a pixel circuit 11*a* and a test unit 15 of an electro-optical device 10*a* according to a second embodiment of the present disclosure.

FIG. 4 is a view illustrating a detailed circuit configuration of a pixel circuit 11*a* and a test unit 15 of an electro-optical device 10*a* according to a second embodiment of the present disclosure. The electro-optical device 10*a* is different from the electro-optical device 10 according to the first embodiment in terms of configuration of a portion of the test unit 15. Also, for the same components described above with reference to FIG. 1 or FIG. 2, the same reference numerals are used and descriptions thereof will be omitted. Also, for the convenience of description and illustration, FIG. 4 illustrates a circuit configuration of one pixel circuit 11*a* corresponding to an address [i, j] ($1 \le i \le m$, $1 \le j \le n$, and i and j are natural numbers), the scan line 13*ai* and the data line 14*aj* corresponding thereto, and the switch SW1 corresponding to the data line 14*aj*, but it is not different for a circuit configuration of a pixel circuit 11*a* corresponding to other addresses, a relationship of the other scan line 13*a* and the other data line 14*a* corresponding thereto, and a relationship of the other data line 14*a* and the other switch SW1 corresponding thereto.

The test voltage supply circuit 15*c* includes a test circuit 15*d*' and a constant current source 15*e*'. The test circuit 15*d*' includes a transistor Td2', a test transistor Tn', a switch SW2 as a power connection switch, a switch SW3 as a gate and drain connection switch, and a switch SW4 as a constant current source connection switch. The transistor Td2' is configured as a PMOS transistor that includes a source terminal S connected to a power source VDD1 as a first power source having a potential of, e.g., 5 V, and a gate terminal G and a drain terminal D commonly connected. Accordingly, the test transistor Tn' may be operated in a saturation region. Also, a resistor element may be provided, instead of the transistor Td2', without being limited thereto. The test transistor Tn' is configured as a PMOS transistor that includes a source terminal S connected to the drain terminal D of the transistor Td2', i.e., connected to the power source VDD1 through the transistor Td2'. Also, in the test transistor Tn', a gate terminal G is connected to the drain terminal D of the switch SW1.

The switch SW2 is configured as a PMOS transistor that includes a source terminal S connected to a power source VDD2 as a second power source having a potential of, e.g., 5 V, a drain terminal D connected to a gate terminal G of the test transistor Tn', and a gate terminal G connected to the test control unit 15*b*. The switch SW2 controls an electrical connection between the gate terminal G of the test transistor Tn' and the power source VDD2.

The switch SW3 is configured as a PMOS transistor that includes a source terminal S connected to the gate terminal G of the test transistor Tn', a drain terminal D connected to the drain terminal D of the test transistor Tn', and a gate terminal G connected to the test control unit 15*b*. The switch SW3 controls an electrical connection between the gate terminal G of the test transistor Tn' and the drain terminal D of the test transistor Tn'.

The switch SW4 is configured as a PMOS transistor that includes a source terminal S connected to the drain terminal D of the test transistor Tn', a drain terminal D connected to the constant current source 15*e*', and a gate terminal G connected to the test control unit 15*b*. The switch SW4 controls an electrical connection between the drain terminal D of the test transistor Tn and the constant current source 15*e*'.

Further, the constant current source 15*e*' is previously set to allow a current Ig having a particular current value to flow to the test transistor Tn'. A voltage level of the test voltage generated by the test voltage supply circuit 15*c* is determined depending on the current Ig.

In the test voltage supply circuit 15*c*, when a low level control signal is supplied from the test control unit 15*b* to the gate terminal G of the switch SW1, the switch SW1 is turned on so that the gate terminal G of the test transistor Tn' is electrically connected to the data line 14*aj*. At this time, while the switch Ts is in the ON state, a test voltage is supplied from the test voltage supply circuit 15*c* to the gate terminal G of the driving transistor Tm to allow the light emitting element OLED to emit light.

Here, when the gate terminal G of the driving transistor Tm and the gate terminal G of the test transistor Tn' are electrically connected, i.e., when the test unit 15 and the pixel circuit 11*a* are electrically connected, the gate terminal G and the drain terminal D of the test transistor Tn' are commonly connected so that the current mirror circuit is constituted with the driving transistor Tm and the test transistor Tn', i.e., with the pixel circuit 11*a* and the test voltage supply circuit 15*c*.

Further, the power source VDD1 and the power source VDD2 may be the same power source. In addition, the driving transistor Tm, the test transistor Tn', the transistor Td1, and the transistor Td2' are formed as PMOS transistors having the same configuration such that voltage-current characteristics thereof are the same, but the present disclosure is not limited thereto.

The test control unit 15*b* is also connected to the gate terminals G of the switches SW2, SW3, and SW4 of the test circuit 15*d*', in addition to the controller 12 and the test unit connection switch 15*a*. Thus, the test control unit 15*b* turns on and off the switches SW2, SW3, and SW4. The test control unit 15*b* supplies control signals to each of the switches SW2, SW3, and SW4 to control on/off operation of the switches, depending on the normal operation signal TDS and the test signal TS3 supplied from the controller 12.

Further, although not shown, in the test circuit 15*d*' of the test unit 15, a plurality of the serial connections of the test transistor Tn' and the transistor Td2' may be connected in parallel between the power source VDD1 and the constant current source 15*e*'. In this case, when allowing the current Ig to flow to the test transistors Tn', the current generated by the constant current source 15*e*' may be increased depending on the number of the test transistors Tn' connected in parallel and as a result, the current Ig flowing in each test transistor Tn' may be more precisely adjusted and thus, the test voltage may be more precisely generated. Even when only the test transistors Tn' are connected between the power source VDD1 and the constant current source 15*e*', the same effect may be obtained. In a case where a plurality of test units 15 are prepared, for example, the test units 15 may be disposed in a grid shape in 40 rows×40 columns and may be configured to be smaller than the area of the display unit 11.

(Normal Light Emitting Operation of Electro-Optical Device 10*a*)

FIG. 5 is a view illustrating ON/OFF states of the switch Ts and the switches SW1 to SW4 in each operation mode of the electro-optical device 10*a* according to the second embodiment of the present disclosure illustrated in FIG. 4. In particular, (a) of FIG. 5 shows the ON/OFF states of the switch Ts and the switches SW1 to SW4 in a normal light emitting operation. The normal light emitting operation of the electro-optical device 10*a* according to the second embodiment is the same as that of the electro-optical device 10 according to the first embodiment and thus, the normal light emitting operation of the electro-optical device 10*a* according to the second embodiment will be described hereinafter, while appropriately omitting descriptions thereof.

In FIG. 4, when the image signal GS is received from the external device 20, based on contents of the image signal GS, the controller 12 generates and outputs an image display control signal GHSS to the scan line driving circuit 13 and the data line driving circuit 14. Further, when the image signal GS is received from the external device 20, the controller 12 generates and supplies a normal operation signal TDS to the test unit 15.

When the image display control signal GHSS is received, in order to select the pixel circuits 11*a* that are determined in the image display control signal GHSS as targets for allowing the corresponding light emitting elements OLEDs to emit light, the scan line driving circuit 13 supplies a low level scan signal to each corresponding scan line 13*a* during a period set in the image display control signal GHSS. Further, when the image display control signal GHSS is received, the data line driving circuit 14 outputs a data signal having voltage levels set by the image display control signal GHSS for each of the data lines 14*a*1 to 14*an* during a period set in the image display control signal GHSS. In addition, when the normal operation signal TDS is received, the test control unit 15*b* of the test unit 15 outputs a low level control signal to the gate terminal G of the switch SW1 during a period set in the normal operation signal TDS to turn off the switch SW1.

When the low level scan signal is supplied to the scan line 13*a*, the switch Ts of the pixel circuit 11*a* is turned on so that the data signal from the data line 14*a* is applied to the gate terminal G of the driving transistor Tm to turn on the driving transistor Tm during a predetermined period. When the driving transistor Tm is turned on, the current IL flows as a driving current according to characteristics of the driving transistor Tm to the light emitting element (OLED) so that the light emitting element (OLED) emits light. At this time, electric charges corresponding to a voltage level of the data signal are accumulated in the capacitor C. Further, since the switch SW1 is turned off during the normal light emitting operation as described above, a test voltage is not applied from the test unit 15 to the gate terminal G of the driving transistor Tm.

When each of the light emitting elements OLEDs of the pixel circuits 11*a* emits light for each predetermined period based on the image display control signal GHSS, a single image on the entire display unit 11 is displayed. Further, as described above, since the electric charges corresponding to the voltage level of the data signal are accumulated in the capacitor C, even after the switch Ts is turned off, a voltage is applied from the capacitor C to the gate terminal G of the driving transistor Tm during a certain period and thus, the light emitting element OLED maintains light emission thereof during the certain period.

When the normal operation signal TDS is received, during a period set in the normal operation signal TDS, the test control unit 15*b* supplies a low level control signal to the gate terminal G of the switch SW2 to turn on the switch SW2, and at the same time, supplies a high level control signal to the gate terminals G of the switches SW3 and SW4 to turn off the switches SW3 and SW4. Accordingly, since the switches SW3 and SW4 are turned off, it may be possible to prevent a current leakage that may occur through the switches SW3 and SW4 from the power sources VDD1 and VDD2 even when the test unit 15 is not used so that the power sources VDD1 and VDD2 may be saved. Further, since the switch SW2 is turned on and thus, a high level voltage from the power source VDD2 is applied to the gate terminal G of the test transistor Tn', the test transistor Tn' can be reliably turned off. Thus, unnecessary power consumption of the power source VDD1 may be suppressed to save power.

(Method of Measuring Characteristics of Electro-Optical Device 10*a*)

Figure 6:
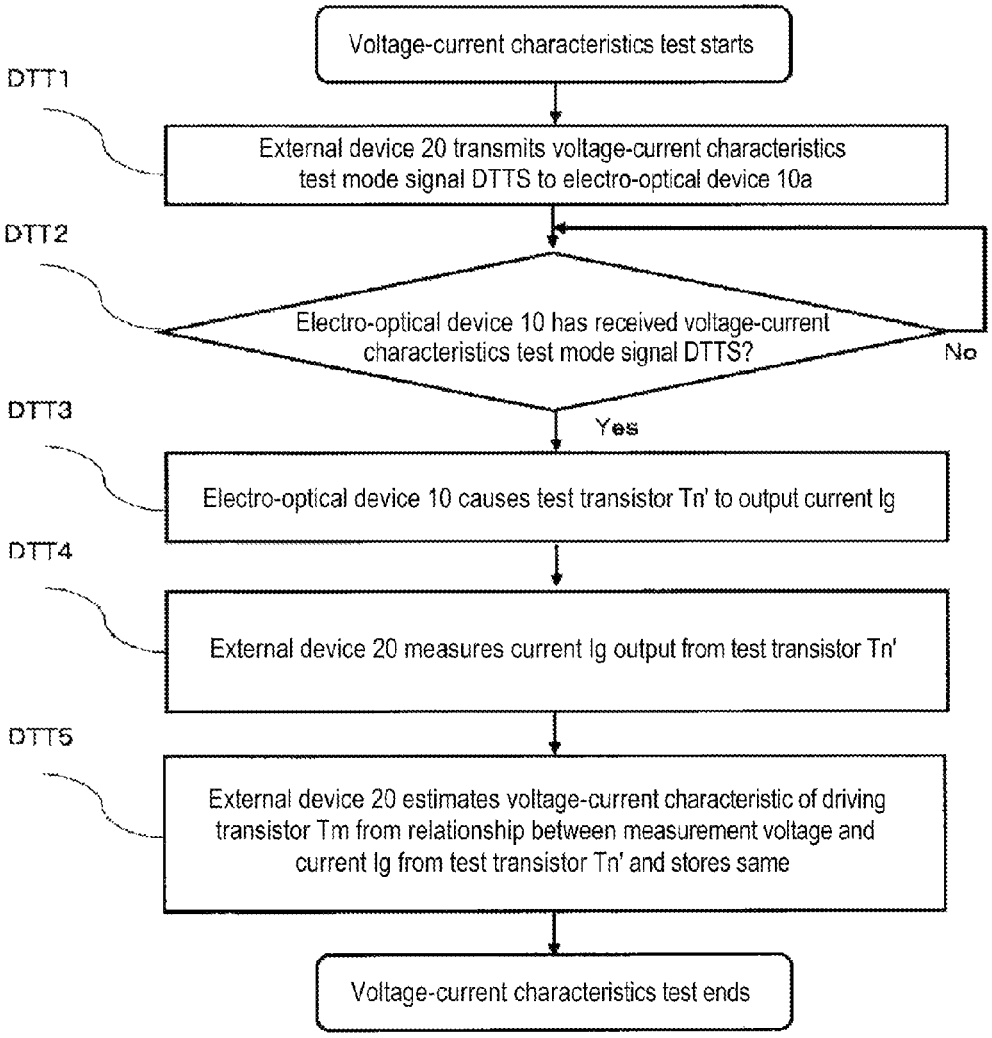
FIG. 6 is a flowchart illustrating a voltage-current characteristics test of the electro-optical device 10*a* according to the second embodiment of the present disclosure.
Figure 7:
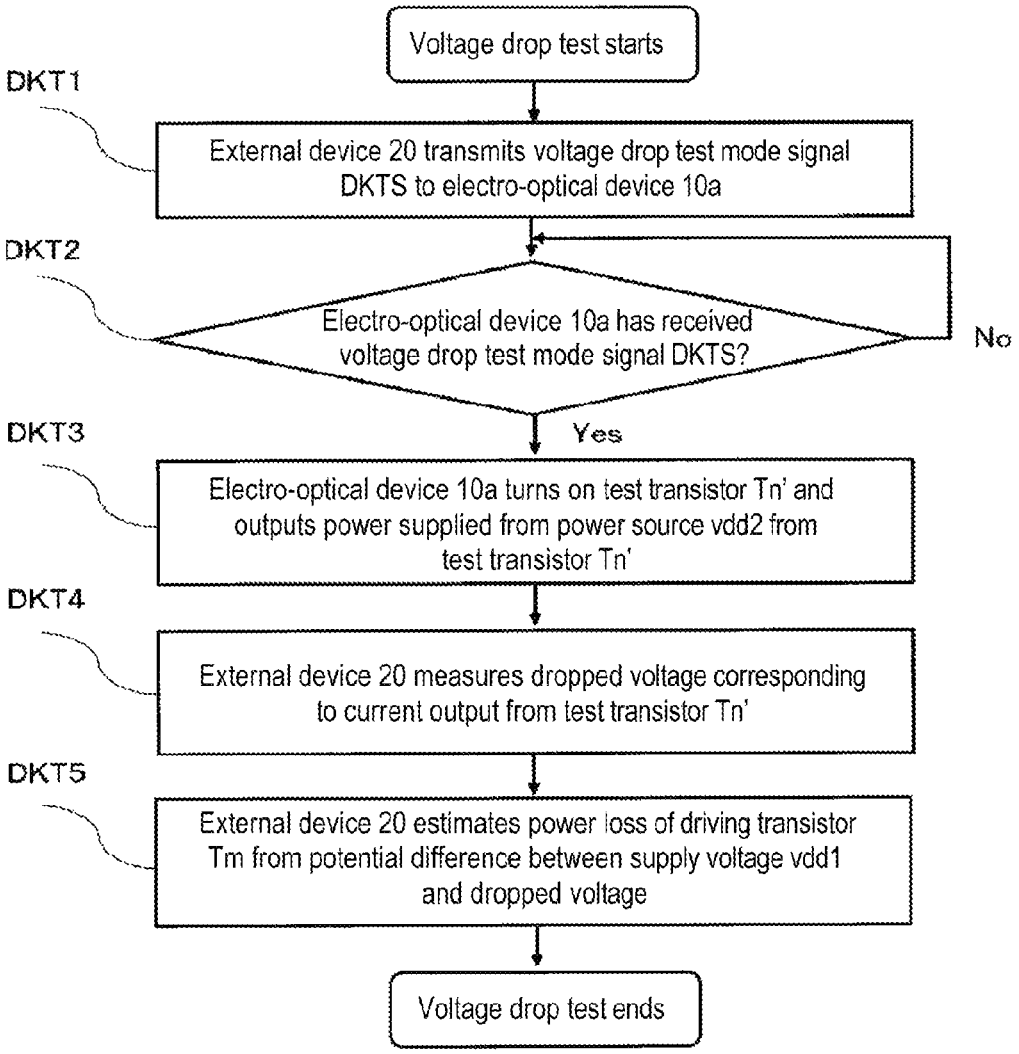
FIG. 7 is a flowchart illustrating a voltage drop test of the electro-optical device 10*a* according to the second embodiment of the present disclosure.

Next, a luminance test, a voltage-current characteristics test, and a voltage drop level test for measuring characteristics of the electro-optical device 10*a* according to the second embodiment of the present disclosure will be described with reference to FIGS. 5 to 7.

In FIG. 5, (b) shows ON/OFF states of the switch Ts and the switches SW1 to SW4 in the luminance test for measuring characteristics of the electro-optical device 10*a* according to the second embodiment of the present disclosure illustrated in FIG. 4. Since the luminance test of this embodiment is the same as that of the first embodiment, descriptions thereof will be appropriately omitted (in this regard, the "electro-optical device 10" illustrated in FIG. 3 may be replaced with the "electro-optical device 10*a*").

In step HKT1, the luminance test mode signal HKTS is output from the external device 20 as a test device. Then, in step HKT2, the electro-optical device 10 determines whether the controller 12 has received the luminance test mode signal HKTS. In step HKT3, when it is determined that the controller 12 has received the luminance test mode signal HKTS, the electro-optical device 10 is switched to the luminance test mode to allow all of the light emitting elements (OLEDs), which are targets of the luminance test, to emit light, by supplying the test voltage from the test unit 15. At this time, in the luminance test according to the second embodiment of the present disclosure, in step HKT3, when the test control unit 15*b* receives a luminance test signal HKS3 from the controller 12, during the period in which the switch Ts is turned on, a high level control signal is supplied to the gate terminal G of the switch SW2 of the test circuit 15*d*' to turn off the switch SW2, while a low level signal is supplied to the gate terminals G of the switches SW3 and SW4 to turn them on.

In step HKT4, when the light emitting element (OLED) is allowed to emit light, the external device 20 measures luminance of the light emitting element OLED of each pixel circuit 11*a* by a camera and stores the measured luminance in a memory (not shown). Then, the luminance test is terminated.

In FIG. 5, (c) shows ON/OFF states of the switch Ts and the switches SW1 to SW4 in the voltage-current characteristics test for measuring characteristics of the electro-optical device 10*a* according to the second embodiment of the present disclosure illustrated in FIG. 4. Further, FIG. 6 is a flowchart of the voltage-current characteristics test.

In the second embodiment of the present disclosure, the voltage-current characteristics test is for estimating the voltage-current characteristics as a relationship between a voltage applied to the gate terminal G of the driving transistor Tm and a current IL output therefrom. The voltage-current characteristics test includes step DTT1 of transmitting a voltage-current characteristics test mode signal DTTS as a test mode signal TMS from the external device 20, which is used as a test device, to the electro-optical device 10*a*, step DTT2 of determining whether the electro-optical device 10*a* has received the voltage-current characteristics test mode signal DTTS from the external device 20, step DTT3 of applying a measurement voltage to the gate terminal G of the test transistor Tn' to turn on the test transistor Tn' to output a current Ig from the test transistor Tn' when it is determined that the electro-optical device 10*a* has received the voltage-current characteristics test mode signal DTTS, step DTT4 of measuring the current Ig output from the test transistor Tn' by the external device 20, and step DTT5 of estimating the voltage-current characteristics of the driving transistor Tm from a relationship between the measurement voltage and the current Ig of the test transistor Tn' measured by the external device 20.

In step DTT1, the external device 20 transmits the voltage-current characteristics test mode signal DTTS to the controller 12 of the electro-optical device 10*a*.

In step DTT2, the electro-optical device 10*a* determines whether the controller 12 has received the voltage-current characteristics test mode signal DTTS.

In step DTT3, when it is determined that the controller 12 has received the voltage-current characteristics test mode signal DTTS, the electro-optical device 10*a* is switched to a voltage-current characteristics test mode and applies the measurement voltage to the gate terminal G of the test transistor Tn' to turn on the test transistor Tn' so that the current Ig is output from the test transistor Tn'. The electro-optical device 10*a* outputs the current Ig from the test transistor Tn' in the following order.

When the electro-optical device 10*a* is switched to the voltage-current characteristics test mode, the controller 12 supplies, to the scan line driving circuit 13, a voltage-current characteristics test signal DTS1 as a test signal TS1 having commands for cutting off an electrical connection between all the pixel circuits 12*a* and the data lines 14*a* within the display unit 11, and also supplies a voltage-current characteristics test signal DTS2 as a test signal TS2 having commands for supplying a data signal having a predetermined voltage level as the measurement voltage to the data line driving circuit 14. Further, the controller 12 supplies a voltage-current characteristics test signal DTS3 as a test signal TS3 having commands for turning off the switches SW2 and SW3 as well as turning on the switches SW1 and SW4 to the test control unit 15*b*.

When the voltage-current characteristics test signal DTS1 is received from the controller 12, the scan line driving circuit 13 supplies a high level scan signal to every scan line 13*a*. Thus, an electrical connection between every pixel circuit 11*a* and the data lines 14*a* is cut off. Further, when the voltage-current characteristics test signal DTS2 is received from the controller 12, the data line driving circuit 14 supplies the measurement voltage to the data line 14*ai*.

In the test unit 15, when receiving the voltage-current characteristics test signal DTS3, the test control unit 15*b* supplies a low level control signal to the gate terminals G of the switches SW1 and SW4 to turn them on. Accordingly, the gate terminal G of the test transistor Tn' provided in the test circuit 15*d*' and the data line 14*ai* are electrically connected and the measurement voltage supplied to the data line 14*ai* is applied to the gate terminal G of the test transistor Tn'. When the measurement voltage is applied to the gate terminal G of the test transistor Tn', the current Ig is output from the test transistor Tn' and flows to a node N between the drain terminal D of the test transistor Tn' and the constant current source 15*e*'. Further, when receiving the voltage-current characteristics test signal DTS3, the test control unit 15*b* supplies a high level control signal to the gate terminals G of the switches SW2 and SW3 to turn off the switches SW2 and SW3. Thus, a potential of the power source VDD2 is not applied to the gate terminal G of the test transistor Tn'.

In step DTT4, the external device 20 measures the current Ig output from the test transistor Tn'. The measurement of the current Ig by the external device 20 is performed by connecting an amperemeter (not shown), which is connected to the external device 20, to the node N between the switch SW4 and the constant current source 15*e*.

In step DTT5, voltage-current characteristics of the driving transistor Tm are estimated from a relationship between the measurement voltage and the current Ig of the test transistor Tn' measured by the external device 20. On the basis of the fact that the test transistor Tn' and the driving transistor Tm have the same configuration, the relationship between the voltage applied to the gate terminal G of the driving transistor Tm and the current IL output therefrom as the voltage-current characteristics of the driving transistor Tm is estimated to be equal to the relationship between the measurement voltage applied to the gate terminal G of the test transistor Tn' and the current Ig. The estimated voltage-current characteristics of the driving transistor Tm are stored in a memory (not shown) connected to the external device 20 and the voltage-current characteristics test is terminated.

In addition, after measuring the voltage-current characteristics of the driving transistor Tm, the external device 20 may determine whether the voltage-current characteristics are within a range of desired characteristics. After determining whether the voltage-current characteristics are within a range of desired characteristics, the external device 20 may also perform a determination of product conformance of the electro-optical device 10*a*. In this case, for example, if the measured voltage-current characteristics of the driving transistor Tm are within the range of the desired characteristics, the electro-optical device 10*a* may be determined to meet product conformance, and if not, the electro-optical device 10*a* may be determined to fail to meet product conformance.

Moreover, the external device 20 may perform the voltage-current characteristics test multiple times with measurement voltages of different voltage levels to estimate and store, in a memory, a current IL of the driving transistor Tm for each voltage level of the measurement voltage. By storing the estimated current IL of the driving transistor Tm corresponding to each voltage level of the measurement voltage in the memory, it is possible to recognize a variation in the current IL with respect to a change in the measurement voltage applied to the gate terminal G of the driving transistor Tm. Accordingly, gamma characteristics of the pixel circuit 11*a* of the electro-optical device 10*a* may be recognized, and accordingly, the image signal GS may be input to the electro-optical device 10*a* in consideration of the gamma characteristics of the electro-optical device 10*a* so that displaying the image data on the display unit 11 may be more precisely controlled.

In FIG. 5, (d) shows ON/OFF states of the switch Ts and the switches SW1 to SW4 in a voltage drop test for measuring characteristics of the electro-optical device 10*a* according to the second embodiment of the present disclosure illustrated in FIG. 4. Further, FIG. 7 is a flowchart of the voltage drop test.

In the second embodiment of the present disclosure, the voltage drop test is for measuring the voltage dropped by the driving transistor Tm from the voltage supplied to the driving transistor Tm from the power source VDD. The voltage drop test includes step DKT1 of transmitting a voltage drop test mode signal DKTS as a test mode signal TMS from the external device 20, which is used as a test device, to the electro-optical device 10*a*, step DKT2 of determining whether the electro-optical device 10*a* has received the voltage drop test mode signal DKTS from the external device 20, step DKT3 of applying a voltage for drop measurement to the gate terminal G of the test transistor Tn' to turn on the test transistor Tn' so that a current supplied from the power source VDD1 is output from the test transistor Tn' when it is determined that the electro-optical device 10*a* has received the voltage drop test mode signal DKTS, step DKT4 of measuring the dropped voltage corresponding to the current output from the test transistor Tn' by the external device 20, and step DKT5 of estimating a dropped voltage of the driving transistor Tm from a potential difference between the power source VDD1 and the dropped voltage.

In step DKT1, the external device 20 transmits a voltage drop test mode signal DKTS to the controller 12 of the electro-optical device 10*a*.

In step DKT2, the electro-optical device 10*a* determines whether the controller 12 has received the voltage drop test mode signal DKTS.

In step DKT3, when it is determined that the controller 12 has received the voltage drop test mode signal DKTS, the electro-optical device 10*a* is switched to a voltage drop test mode and a voltage for drop measurement is applied to the gate terminal G of the test transistor Tn to turn on the test transistor Tn so that a current supplied from the power source VDD1 is output, as a current Ig, from the test transistor Tn. The electro-optical device 10*a* outputs a current Ig from the test transistor Tn in the following order.

When the electro-optical device 10 is switched to the voltage drop test mode, the controller 12 supplies, to the scan line driving circuit 13, the voltage drop test signal DKS1 as the test signal TS1 having commands for cutting off an electrical connection between all the pixel circuits 11*a* and the data lines 14*a* within the display unit 11, and also supplies the voltage drop test signal DKS2 as the test signal TS2 having commands for supplying, to the data line driving circuit 14, a data signal having a GND voltage level allowing the test transistor Tn' to output a maximum current value as a voltage for drop measurement. Further, the controller 12 supplies the voltage drop test signal DKS3 as the test signal TS3 having commands for turning off the switches SW2 and SW3 as well as turning on the switches SW1 and SW4, to the test control unit 15*b*.

When the voltage drop test signal DKS1 is received from the controller 12, the scan line driving circuit 13 supplies a high level scan signal to every scan line 13*a*. Thus, an electrical connection between the pixel circuit 11*a* and the data line 14*a* is cut off. Further, when the voltage drop test signal DKS2 is received from the controller 12, the data line driving circuit 14 supplies the voltage for drop measurement to the data line 14*ai*. In the test unit 15, when receiving the voltage drop test signal DKS3, the test control unit 15*b* supplies a low level control signal to the gate terminals G of the switches SW1 and SW4 to turn on the switches SW1 and SW4. Accordingly, the gate terminal G of the test transistor Tn' provided in the test circuit 15*d*' and the data line 14*ai* are electrically connected and the voltage for drop measurement supplied to the data line 14*ai* is applied to the gate terminal G of the test transistor Tn'. When the voltage for drop measurement is applied to the gate terminal G of the test transistor Tn', the current Ig is output from the test transistor Tn' and flows to the node N between the drain terminal D of the test transistor Tn' and the constant current source 15*e*'. Further, when receiving the voltage drop test signal DKS3, the test control unit 15*b* supplies a high level control signal to the gate terminals G of the switches SW2 and SW3 to turn off the switches SW2 and SW3. Thus, a potential of the power source VDD2 is not applied to the gate terminal G of the test transistor Tn'.

In step DKT4, the external device 20 measures a dropped voltage corresponding to the current Ig output from the test transistor Tn'. The measurement of the dropped voltage by the external device 20 is performed by connecting a voltmeter (not shown), which is connected to the external device 20, to the node N between the switch SW4 and the constant current source 15*e*'.

In step DKT5, the external device 20 estimates a dropped voltage of the driving transistor Tm from a potential difference between the power source VDD2 and the dropped voltage. The estimated dropped voltage of the driving transistor Tm is stored in a memory (not shown) electrically connected to the external device 20 and the voltage drop test is terminated. Here, the dropped voltage of the driving transistor Tm is estimated to be equal to the dropped voltage of the test transistor Tn on the basis of the fact that the test transistor Tn and the driving transistor Tm has the same configuration.

Further, after measuring the dropped voltage of the driving transistor Tm, the external device 20 may determine whether the dropped voltage level is within a predetermined range. After determining whether the dropped voltage level is within the desired range, the external device 20 may also perform a determination of product conformance of the electro-optical device 10*a*. In addition, the external device 20 may estimate a voltage applied to both ends of the light emitting element (OLED) by subtracting the measured dropped voltage of the driving transistor Tm from the power source VDD1.

(Effects of Second Embodiment)

In the electro-optical device 10*a* according to the second embodiment of the present disclosure, since the switch SW4 is provided, it is possible to prevent a current leakage that may occur through the switch SW4 from the power source VDD1 and the power source VDD2 even when the test unit 15 is not used so that power may be saved.

Further, since the test unit 15 has the switch SW3, by turning on the switch SW3, in the luminance test in which the gate terminal G and the drain terminal D of the test transistor Tn' are required to be connected, the test unit 15 may supply the test voltage to the pixel circuit 11*a*. In addition, by turning off the switch SW3, in the voltage-current characteristics test in which the gate terminal G and the drain terminal D of the test transistor Tn' are required to be electrically disconnected, the voltage-current characteristics of the test transistor Tn' may be measured. Thus, even when a plurality of characteristics measurements are performed in the electro-optical device 10*a*, since there is no need to install each test unit 15 dedicated for each of the characteristics measurement tests, an increase of area on a semiconductor chip in which the electro-optical device 10*a* is provided can be restrained.

Third Embodiment

An electro-optical device 10*b* according to a third embodiment of the present disclosure will be described with reference to FIGS. 8 to 11. For the same components as those described above in the first and second embodiments, the same reference numerals are used and descriptions thereof will be omitted.

Figure 8:
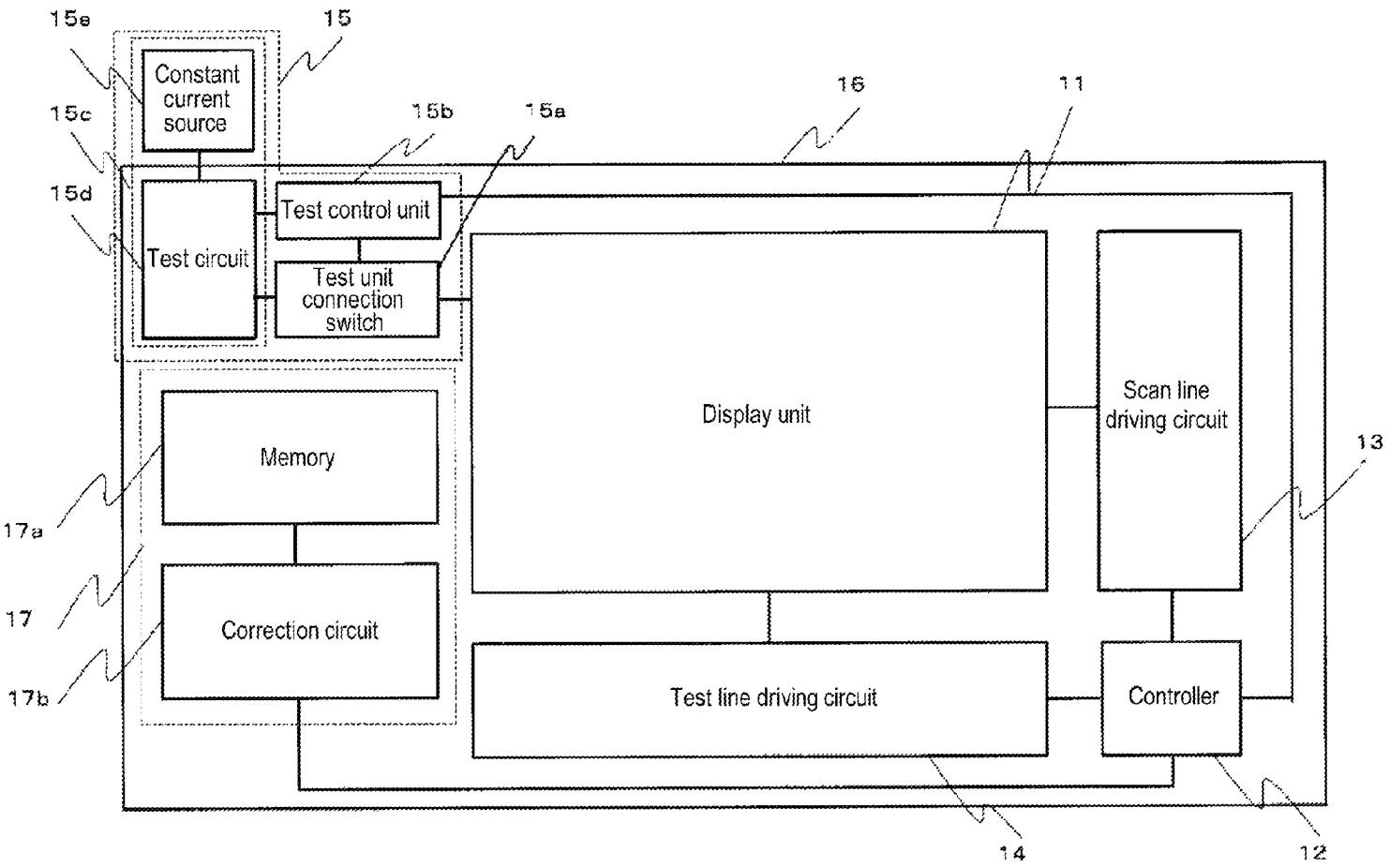
FIG. 8 is a block diagram illustrating a configuration of an electro-optical device 10*b* according to a third embodiment of the present disclosure.

FIG. 8 is a block diagram illustrating a configuration of the electro-optical device 10*b* according to a third embodiment of the present disclosure. The electro-optical device 10*b* according to the third embodiment includes a semiconductor chip 16 having a display unit 11, a controller 12, a scan line driving circuit 13, a data line driving circuit 14, a test unit connection switch 15*a*, a test control unit 15*b*, and a test circuit 15*d* formed on a common semiconductor substrate, and a constant current source 15*e*. In this embodiment, as the test circuit, the test circuit 15*d* described in the first embodiment will be described, but the test circuit 15*d*' described in the second embodiment may also be applied as the test circuit. The constant current source 15*e* of the test unit 15 is formed outside of the semiconductor chip 16.

The test circuit 15*d* is disposed to be adjacent to the display unit 11. When the test circuit 15*d* is disposed to be adjacent to the display unit 11 if the semiconductor chip 16 is viewed from a plan view, it is possible to restrain an increase of a distance between a driving transistor Tm provided in a pixel circuit 11*a* of the display unit 11 and a test transistor Tn provided in the test circuit 15*d*. Thus, in the semiconductor chip 16, a length of wiring for connecting a gate terminal G of the driving transistor Tm and a gate terminal G of the test transistor Tn can be reduced so that an increase in impedance of the wiring can be restrained. Thus, a current Ig flowing in the test transistor Tn may be more precisely generated as a current IL with a driving current of the driving transistor Tm.

Further, as described above, the test circuit 15*d* is disposed to be adjacent to the display unit 11, spaced apart from the scan line driving circuit 13 and the data line driving circuit 14, rather than being adjacent thereto, and away from each of the scan line driving circuit 13 and the data line driving circuit 14 with the display unit 11 interposed therebetween. If the test circuit 15*d* is disposed to be adjacent to the display unit 11, spaced apart from the scan line driving circuit 13 and the data line driving circuit 14, rather being adjacent thereto, and away from each of the scan line driving circuit 13 and the data line driving circuit 14 with the display unit 11 interposed therebetween, even when the test circuit 15*d* is disposed within the semiconductor chip 16, the scan line driving circuit 13 and the data line driving circuit 14 may be disposed to be adjacent to the display unit 11, and thus, an increase in the distance from each of the scan line driving circuit and the data line driving circuit 14 to the display unit 11 may be restrained.

In addition, as illustrated in FIG. 8, the constant current source 15*e* is installed outside of the semiconductor chip 16. Since the constant current source 15*e* is provided outside of the semiconductor chip 16, a circuit area of the constant current source 15*e* is not limited by the semiconductor chip 16. Thus, while an increase in the area of the semiconductor chip 16 is restrained, a larger current Ig may be generated and the current Ig generated by the constant current source 15*e* may be easily adjusted so that a luminance test of the electro-optical device 10*b* can be more precisely performed, compared with a case in which the constant current source 15*e* is formed within the semiconductor chip.

Moreover, in the second embodiment of the present disclosure, in has been described that in the voltage-current characteristics test, the current Ig of the test transistor Tn is measured and the voltage-current characteristics of the driving transistor Tm is estimated by using the measured current Ig of the test transistor Tn'. The voltage-current characteristics test in this manner exhibits greater effects, particularly when the electro-optical device 10*b* is formed to have the semiconductor chip 16 therein as described above. The reasons are as follows. The target driving transistor Tm for the voltage-current characteristics test is formed to be connected to the light emitting element OLED within the semiconductor chip 16. Here, if an amperemeter is connected to the node N between the driving transistor Tm and the light emitting element (OLED) to perform the voltage-current characteristics test, it is required to connect the node N between the driving transistor Tm and the light emitting element OLED to an external terminal provided in the semiconductor chip 16 with other wiring and also to connect the amperemeter to the external terminal. However, if the other wiring is connected to the node N between the driving transistor Tm and the light emitting element OLED, parasitic capacitance of the other wiring may affect the node N during the normal light emitting operation, resultantly affecting luminance characteristics of the light emitting element (OLED), so that it causes an obstacle when an image from the display unit 11 is output with high precision. For these reasons, it is more effective to measure the current Ig of the test transistor Tn and to estimate the voltage-current characteristics of the driving transistor Tm by using the measured current Ig, as in the voltage-current characteristics test according to the second embodiment of the present disclosure. In addition, there is no difference in the voltage drop test with respect to the second embodiment of the present disclosure.

Further, as illustrated in FIG. 8, a correction circuit block 17 may be disposed between the test circuit 15*d* and the data line driving circuit 14 within the semiconductor chip 16. The correction circuit block 17 may include, for example, a memory 17*a* for storing correction values with respect to transistor characteristics of the driving transistor Tm varying depending on temperature changes. The correction circuit block 17 may also include a correction circuit 17*b* for correcting a voltage applied to the gate terminal G of the driving transistor Tm based on an image data input to the electro-optical device 10*b*, with reference to the temperature information and the information in the memory 17*a*. In addition, the correction values for a voltage applied to the gate terminal G of the driving transistor Tm based on the image data input to the electro-optical device 10*b*, which is output from the correction circuit 17*b*, is input, for example, to the controller 12. The controller 12 may determine a data signal as a voltage applied to the gate terminal G of the driving transistor Tm based on the correction value.

Figure 9:
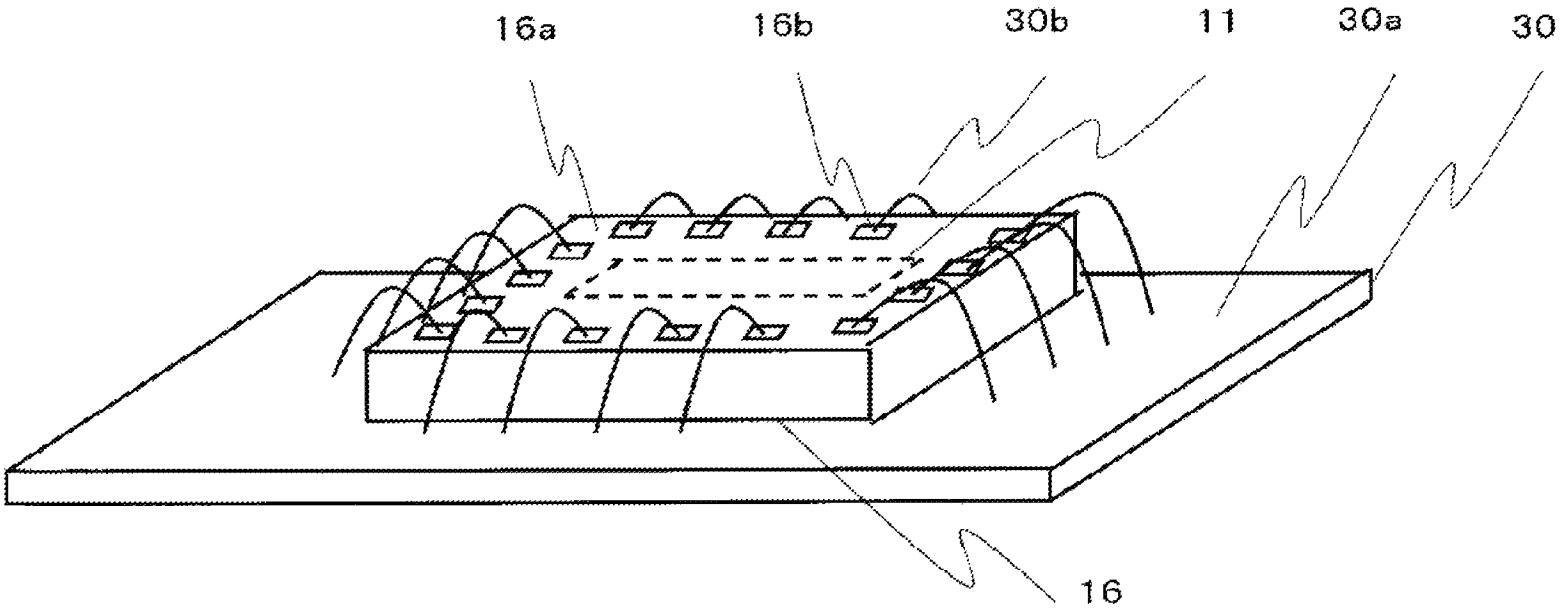
FIG. 9 is a view illustrating a state in which a semiconductor chip 16 of the electro-optical device 10*b* according to the present disclosure is mounted on a substrate 30.

FIG. 9 is a view illustrating a state in which the semiconductor chip 16 of the electro-optical device 10*b* according to the present disclosure is mounted on a substrate 30.

The semiconductor chip 16 is mounted on the substrate 30, for example, according to a wire bonding scheme. The semiconductor chip 16 has a first main surface adjacent to the substrate 30 and a second main surface 16*a* on the opposite side of the first main surface, where the display unit 11 is formed. Further, on the second main surface 16*a* of the semiconductor chip 16, a plurality of electrode pads 16*b* for transmitting and receiving a signal between the semiconductor chip 16 and the outside are formed.

The substrate 30 has a first main surface 30*a* which is in contact with the semiconductor chip 16 and a second main surface (not shown) opposing the first main surface 30*a*. A predetermined wiring (not shown) is formed on the first main surface 30*a*, which may extend to the second main surface of the substrate 30. Further, since the substrate 30 is connected to the electrode pad 16*b* of the semiconductor chip 16 through a wire 30*b*, the substrate 30 and the semiconductor chip 16 are electrically connected by the wire 30*b*.

Also, the semiconductor chip 16 may be formed as a chip size package (CSP) and, in this case, the semiconductor chip 16 may be mounted on the substrate 30 by an external terminal installed on the first main surface.

Figure 10:
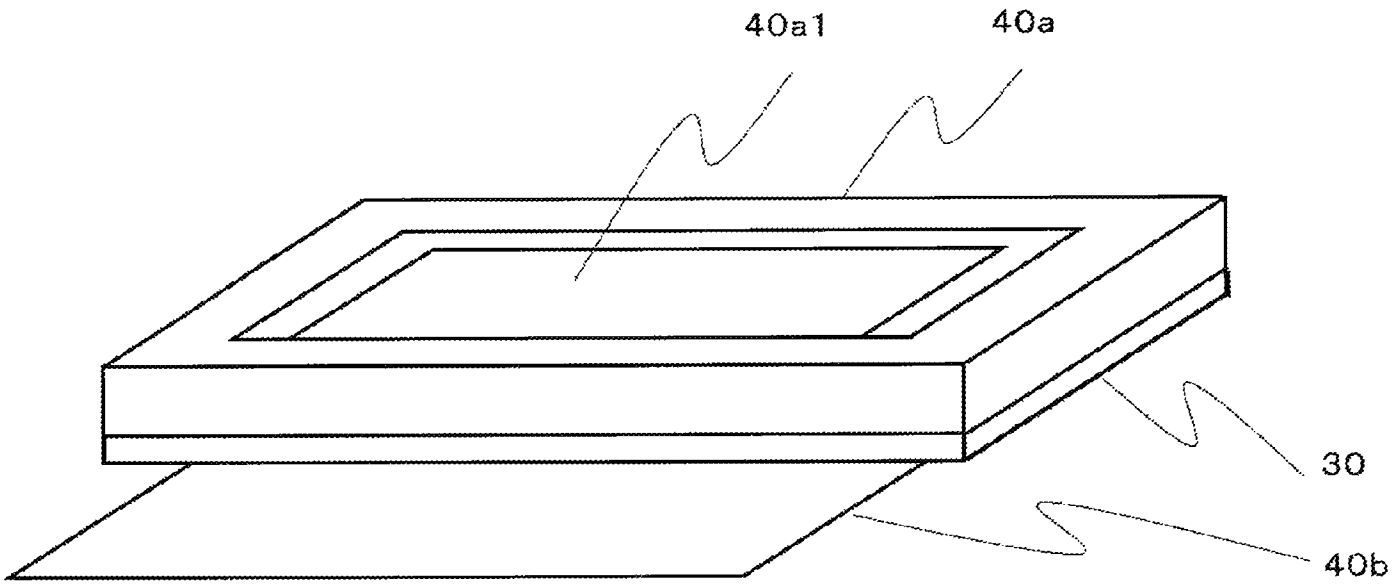
FIG. 10 is a view schematically illustrating an electro-optical module 40 using the electro-optical device 10*b* according to the present disclosure.

FIG. 10 is a view schematically illustrating an electro-optical module 40 equipped with the electro-optical device 10*b* according to the present disclosure.

The electro-optical module 40 includes a semiconductor chip 16 (not shown), a substrate 30, a case 40*a*, and a flexible cable 40*b*. Since the semiconductor chip 16 is covered with the case 40*a*, illustration thereof is omitted.

As illustrated in FIG. 10, the case 40*a* is mounted on the substrate 30 to cover the semiconductor chip 16 mounted on the substrate 30. Further, the case 40*a* has a transparent plate 40*a*1 configured to allow light emitted from the display unit 11 to be transmitted therethrough, on the second main surface 16*a* of the semiconductor chip 16. The transparent plate 40*a*1 is mounted on the substrate 30 to be parallel to the second main surface 16*a*.

The flexible cable 40*b* is connected to the second main surface of the substrate 30 and electrically connected to the semiconductor chip 16 through the wiring extending from the second main surface (not shown) to the first main surface 30*a* and the wire 30*b*, through which the semiconductor chip 16 as the electro-optical device 10*b* is electrically connected to an external device as the electro-optical module 40 accordingly.

Also, the electro-optical module illustrated in FIG. 10 may be mounted on a head mount display (not shown) and an electronic viewfinder (not shown), or the like.

Figure 11:
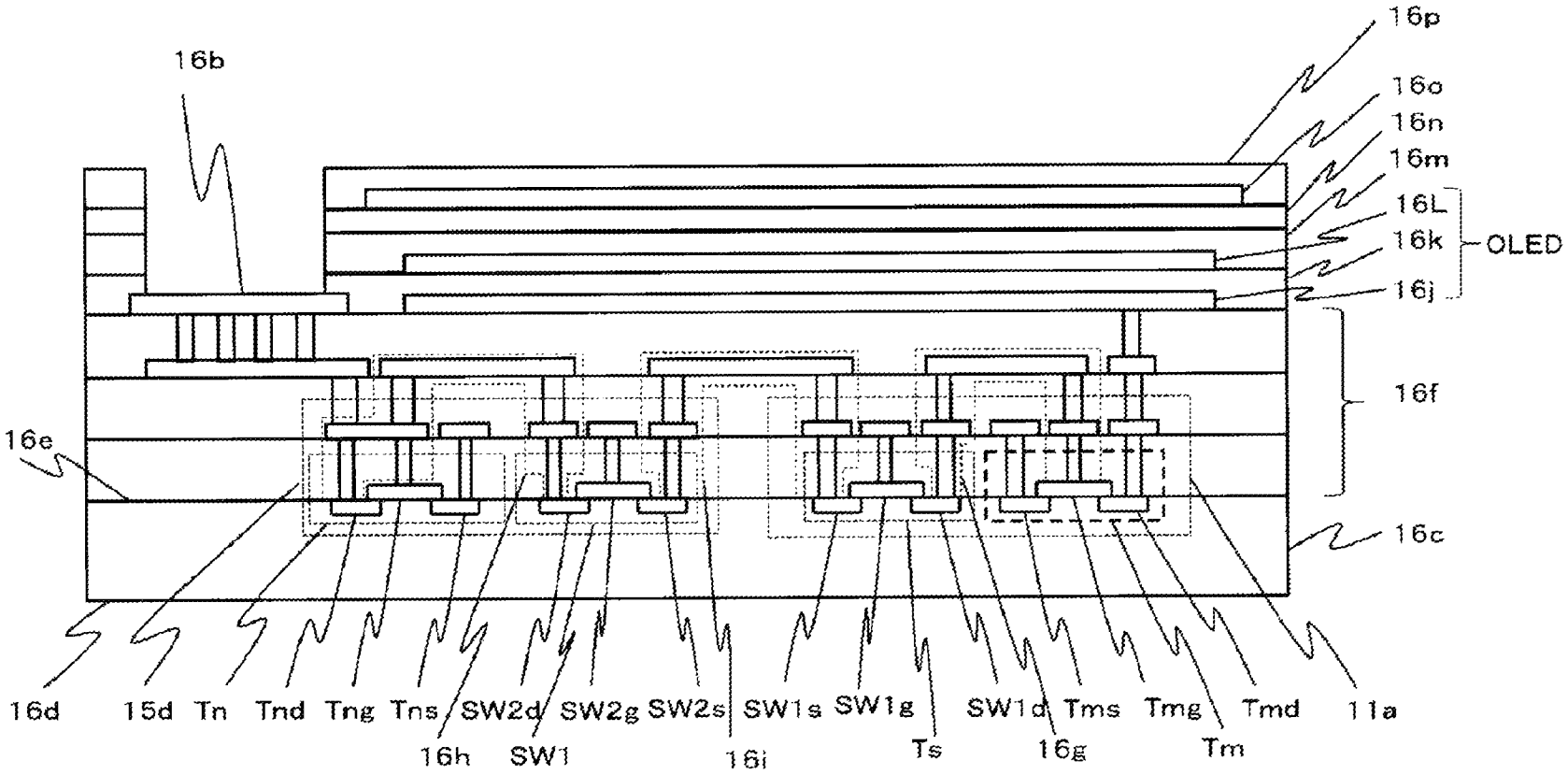
FIG. 11 is a cross-sectional view illustrating a semiconductor chip 16 of the electro-optical device 10*b* according to the third embodiment of the present disclosure.

FIG. 11 is a cross-sectional view illustrating the semiconductor chip 16 of the electro-optical device 10*b* according to the third embodiment of the present disclosure. In the semiconductor chip 16, the pixel circuit 11*a* of the display unit 11, the switch SW1 of the test unit connection switch 15*a* of the test unit 15, the test circuit 15*d*, and the light emitting element (OLED) are formed on a semiconductor substrate 16*c*. Also, although the controller 12, the scan line driving circuit 13, the data line driving circuit 14, and the correction circuit block 17 illustrated as the components of the semiconductor chip 16 in FIG. 8 are omitted in FIG. 11 for the convenience of description and drawings, these components are also formed on the semiconductor substrate 16*c*.

The semiconductor substrate 16*c* is a semiconductor substrate having N-type conductive properties, and has a first main surface 16*d* and a second main surface 16*e* opposing the first main surface 16*d*.

The pixel circuit 11*a* and the test circuit 15*d* are formed on the second main surface 16*e* of the semiconductor substrate 16*c*.

The pixel circuit 11*a* is formed to have the driving transistor Tm and the switch Ts. A source region Tms as a source terminal S of the driving transistor Tm and a drain region Tmd as a drain terminal D of the driving transistor Tm are formed to be spaced apart from one another within the second main surface 16*e* of the semiconductor substrate 16*c*. A gate electrode Tmg as a gate terminal G of the driving transistor Tm is formed between the source region Tms and the drain region Tmd on the second main surface 16*e*. A source region SW1*s* as a source terminal S of the switch Ts and a drain region SW1*d* as a drain terminal D of the switch Ts are formed to be spaced apart from one another within the second main surface 16*e* of the semiconductor substrate 16*c*. A gate electrode SW1*g* as a gate terminal G of the switch Ts is formed between the source region SW1*s* and the drain region SW1*d* on the second main surface 16*e*.

Further, the gate electrode Tmg of the driving transistor Tm and the drain region SW1*d* of the switch Ts are electrically connected through a wiring 16*g* among interlayer wiring layers 16*f* formed by alternately installing insulating films and wiring layers while covering the driving transistor Tm and the switch Ts on the second main surface 16*e* of the semiconductor substrate 16*c*.

The switch SW1 is formed such that a source region SW2*s* as a source terminal S thereof and a drain region SW2*d* as a drain terminal D thereof are spaced apart from one another within the second main surface 16*e* of the semiconductor substrate 16*c*, and a gate electrode SW2*g* as a gate terminal G is formed between the source region SW2*s* and the drain region SW2*d* on the second main surface 16*e*.

The test circuit 15*d* is formed to have the test transistor Tn. A source region Tns as a source terminal S of the test transistor Tn and a drain region Tnd as a drain terminal D of the test transistor Tn are formed to be spaced apart from one another within the second main surface 16*e* of the semiconductor substrate 16*c* through ion implantation. A gate electrode Tmg as a gate terminal G of the driving transistor Tm is formed between the source region Tms and the drain region Tmd on the second main surface 16*e*.

A gate electrode Tng and the drain region Tnd of the test transistor Tn and the drain region SW2*d* of the switch SW1 are electrically connected through a wiring 16*h* among interlayer wiring layers 16*f* formed by alternately installing insulating films and wiring layers while covering the test transistor Tn and the switch SW1 on the second main surface 16*e* of the semiconductor substrate 16*c*.

Also, the pixel circuit 11*a* and the switch SW1 are connected through a wiring 16*i* of the interlayer wiring layers 16*f*.

The light emitting element (OLED) includes a lower electrode 16*j*, a light emitting member 16*k* formed to cover the lower electrode 16*j*, and an upper electrode 16L formed on the light emitting member 16*k* on the interlayer wiring layers 16*f* on the second main surface 16*e*. The lower electrode 16*j* is connected to the drain region Tmd of the driving transistor Tm through a wiring formed within the interlayer wiring layers 16*f*. The lower electrode 16*j* and the upper electrode 16L may be formed of aluminum (Al), but is not limited thereto. Any member that is generally used for wiring within a semiconductor chip may be variously adopted. For example, copper (Cu), tungsten (W), or the like may be applied. The light emitting member 16*k* may be formed of an organic member, but is not limited thereto. Any member that receives a current to be self-luminous may be variously adopted.

Further, the light emitting element OLED emits light when a current is supplied to the lower electrode 16*j* from the drain region Tmd of the driving transistor Tm.

A protective film 16*m* is formed to cover the pixel circuit 11*a*, the test circuit 15*d*, the interlayer wiring layers 16*f*, and the light emitting element OLED formed on the second main surface 16*e* for the purpose of preventing permeation of moisture into functional circuits of the semiconductor chip 16 including the upper electrode 16L from the outside. The protective film 16*m* is formed of, for example, silicon nitride (SiN), but is not limited thereto. Any member that can be generally used as a protective film in a semiconductor chip may be variously adopted. For example, silicon oxide (SiO2), a silicon oxynitride (SiON), or the like may be applied.

A color filter 16*o* is attached to the protective film 16*m* by an optically transparent adhesive layer 16*n*. The color filter 16*o* serves to extract a red, green, or blue light from white light of the light emitting member 16*k*. The color filter 16*o* includes a red filter (not shown), a green filter (not shown), and a blue filter (not shown). Each of the red filter, the green filter, and the blue filter is formed of a resin mixed with pigment and is adjusted respectively, by selecting the pigment, to have a high light transmittance in a red, green, or blue wavelength region, while having a low light transmittance in other wavelength region as intended. Further, as a material of the adhesive layer 16*n* for bonding the color filter 16*o* and the protective film 16*m*, a visible light curing resin, a thermosetting resin, a two-component curable resin, or a UV-delay curing resin may be used, but is not limited thereto. Any material having light transmittance may be variously adopted.

A protective film 16*p* is formed to cover the color filter 16*o* so that it serves to prevent dust, or the like from being attached to the color filter 16*o*.

An electrode pad 16*b* is formed of the same member as a member used for the interlayer wiring layers 16*f* and formed to be electrically connected to the drain region Tnd of the test transistor Tn through a wiring formed in the uppermost layer of the interlayer wiring layers 16*f*.

According to the present disclosure, it is possible to reduce the time required for a test to measure characteristics of a pixel circuit and an increase of manufacturing cost is restrained.

Since the electro-optical device according to the present disclosure can restrain an increase in manufacturing cost, industrial applicability is extremely high.

While certain embodiments have been described, these embodiments have been presented by way of example only, and are not intended to limit the scope of the disclosures. Indeed, the novel methods and devices described herein may be embodied in a variety of other forms; furthermore, various omissions, substitutions and changes in the form of the embodiments described herein may be made without departing from the spirit of the disclosures. The accompanying claims and their equivalents are intended to cover such forms or modifications as would fall within the scope and spirit of the disclosures.

What is claimed is:

1. An electro-optical device, comprising:

a display unit having a plurality of pixel circuits each including a driving transistor and a light emitting element that emits light depending on a current output from the driving transistor when a voltage is applied to a gate terminal of the driving transistor; and a test unit having a test unit connection switch connected to the gate terminal of the driving transistor of each of the pixel circuits, and a test voltage supply circuit connected to the gate terminal of each of the driving transistors through the test unit connection switch and configured to supply a test voltage to the gate terminal of each of the driving transistors when the test unit connection switch is turned on, wherein the test voltage supply circuit comprises a constant current source, wherein a voltage level of the test voltage is determined depending on a current level set in the constant current source, wherein the test voltage supply circuit comprises a test transistor including a gate terminal with which the gate terminal of the driving transistor is electrically connected under control of the test unit connection switch, and wherein the constant current source is connected to a drain terminal of the test transistor and the gate terminal of the test transistor is connected to the drain terminal of the test transistor.

2. The device of claim 1, wherein the pixel circuit and the test voltage supply circuit are configured to constitute a current mirror circuit when the gate terminal of each of the driving transistors and the gate terminal of the test transistor are electrically connected.

3. The device of claim 2, wherein the test unit comprises a constant current source connection switch configured to control an electrical connection between the drain terminal of the test transistor and the constant current source.

4. The device of claim 2, wherein the test voltage supply circuit comprises a power connection switch configured to control an electrical connection between the gate terminal of the test transistor and a first power source.

5. The device of claim 2, wherein the test voltage supply circuit comprises a gate-drain connection switch configured to control an electrical connection between the gate terminal and the drain terminal of the test transistor.

6. The device of claim 2, wherein the driving transistor and the test transistor have the same configuration.

7. The device of claim 1, comprising:

a data line driving circuit connected to the gate terminal of the driving transistor through a data line; and a scan line driving circuit configured to control a pixel selection switch provided between the data line and the gate terminal of the driving transistor to control an electrical connection between the data line and the gate terminal of the driving transistor, wherein the data line driving circuit is configured to apply a predetermined voltage to the gate terminal of the driving transistor through the data line when the pixel selection switch is turned on to make an electrical connection between the data line and the gate terminal of the driving transistor under the control of the scan line driving circuit.

8. The device of claim 7, comprising:

a controller configured to control operations of the data line driving circuit and the scan line driving circuit.

9. The device of claim 8, wherein the display unit, the test transistor, the data line driving circuit, the scan line driving circuit, and the controller are formed on a single semiconductor substrate to constitute a semiconductor device.

10. The device of claim 9, wherein, on the semiconductor substrate, an area occupied by the test unit is smaller than that occupied by the display unit.

11. A method of measuring characteristics of an electro-optical device, the electro-optical device comprising a display unit having a plurality of pixel circuits each including a driving transistor and a light emitting element that emits light depending on a current output from the driving transistor when a voltage is applied to a gate terminal of the driving transistor, and a test unit connected to the gate terminal of the driving transistor of each of the pixel circuits, wherein, for a luminance test that measures luminance of the light emitting element included in each of the pixel circuits, the method comprising:

transmitting a luminance test mode signal from a test device to the electro-optical device;

determining whether the electro-optical device has received the luminance test mode signal;

when it is determined that the electro-optical device has received the luminance test mode signal, for each light emitting element that is a target of the luminance test, supplying a test voltage from the test unit to the gate terminal of the driving transistor to allow the light emitting element to emit light; and measuring, by the test device, luminance obtained when the light emitting element of the electro-optical device is allowed to emit light, wherein the test unit of the electro-optical device further comprises:

a test transistor connected to the gate terminal of the driving transistor; and a gate-drain connection switch configured to control an electrical connection between a gate terminal and a drain terminal of the test transistor, and wherein, in the luminance test, the pixel circuit and the test unit constitute a current mirror circuit when the gate terminal and the drain terminal of the test transistor are connected by turning on the gate-drain connection switch.

12. The method of claim 11, wherein, for a voltage-current characteristics test that estimates a relationship between a voltage applied to the gate terminal of the driving transistor and a current to be obtained when the voltage is applied to the gate terminal of the driving transistor, the method comprising:

transmitting a voltage-current characteristics test mode signal from the test device to the electro-optical device;

determining whether the electro-optical device has received the voltage-current characteristics test mode signal;

when it is determined that the electro-optical device has received the voltage-current characteristics test mode signal, electrically cutting off the gate terminal and the drain terminal of the test transistor by turning off the gate-drain connection switch, while applying a measurement voltage to the gate terminal of the test transistor so that a test current is output from the test transistor;

measuring, by the test device, the test current output from the test transistor; and estimating, by the test device, voltage-current characteristics of the driving transistor from a relationship between the measurement voltage applied to the gate terminal of the test transistor and the measured test current.

13. The method of claim 11, wherein, for a voltage drop test that estimates a dropped voltage of the driving transistor, the method comprising:

transmitting a voltage drop test mode signal from the test device to the electro-optical device;

determining whether the electro-optical device has received the voltage drop test mode signal;

when it is determined that the electro-optical device has received the voltage drop test mode signal, electrically cutting off the gate terminal and the drain terminal of the test transistor by turning off the gate-drain connection switch, while applying a voltage for drop measurement to the gate terminal of the test transistor so that a test current based on a source voltage is output from the test transistor;

measuring, by the test device, a dropped voltage with respect to the test current output from the test transistor; and estimating, by the test device, a dropped voltage of the driving transistor from a potential difference between the source voltage and the measured dropped voltage.

14. A semiconductor chip, comprising:

a display unit having a plurality of pixel circuits each including a driving transistor and a light emitting element that emits light depending on a current output from the driving transistor when a voltage is applied to a gate terminal of the driving transistor; and a test unit having a test unit connection switch connected to the gate terminal of the driving transistor of each of the pixel circuits, and a test transistor including a gate terminal with which the gate terminal of each of the driving transistors is connected through the test unit connection switch and also including a drain terminal connected to the gate terminal thereof, and configured to supply a test voltage to the gate terminal of each of the driving transistors when the test unit connection switch is turned on.

15. The semiconductor chip of claim 14, wherein the driving transistor and the test transistor have the same configuration.

16. The semiconductor chip of claim 14, further comprising:

a data line driving circuit connected to the gate terminal of the driving transistor through a data line; and a scan line driving circuit configured to control a pixel selection switch provided between the data line and the gate terminal of the driving transistor to control an electrical connection, wherein the data line driving circuit is configured to apply a predetermined voltage to the gate terminal of the driving transistor through the data line when the pixel selection switch is turned on to make an electrical connection between the data line and the gate terminal of the driving transistor under the control of the scan line driving circuit.

17. The semiconductor chip of claim 16, further comprising:

a controller configured to control operations of the data line driving circuit and the scan line driving circuit.

* * * * *